US007690083B2

(12) United States Patent
Ramsauer

(10) Patent No.: US 7,690,083 B2
(45) Date of Patent: Apr. 6, 2010

(54) CLIP FIXTURE FOR THE FAST ASSEMBLY OF FITTINGS, SUCH AS SWIVELING LEVER-TYPE CLOSURES AND HINGE PARTS, IN BREAKTHROUGHS OF A THIN WALL

(76) Inventor: Dieter Ramsauer, Max-Klein-Str. 10, D-58332 Schwelm (DE)

( * ) Notice: Subject to any disclaimer, the term of this patent is extended or adjusted under 35 U.S.C. 154(b) by 680 days.

(21) Appl. No.: 10/587,352

(22) PCT Filed: Jan. 26, 2005

(86) PCT No.: PCT/EP2005/000755

§ 371 (c)(1),
(2), (4) Date: Jan. 26, 2007

(87) PCT Pub. No.: WO2005/071199

PCT Pub. Date: Aug. 4, 2005

(65) Prior Publication Data

US 2007/0175252 A1 Aug. 2, 2007

(30) Foreign Application Priority Data

Jan. 26, 2004 (DE) ..... 20 2004 001 161 U
Feb. 27, 2004 (DE) ..... 20 2004 003 238 U

(51) Int. Cl.
*E05D 5/00* (2006.01)

(52) U.S. Cl. ..... 16/382; 16/383; 16/258; 411/342; 411/913

(58) Field of Classification Search ..... 16/382, 16/383, 257, 258, 271, 272, 2.1, 2.2, 422, 16/DIG. 22, DIG. 40–DIG. 41; 24/289, 297, 24/453, 581.11; 411/508, 913, 342
See application file for complete search history.

(56) References Cited

U.S. PATENT DOCUMENTS

| | | | | |
|---|---|---|---|---|
| 531,791 | A * | 1/1895 | Fischer | 217/106 |
| 577,285 | A * | 2/1897 | Caugherty | 213/40 R |
| 1,538,320 | A * | 5/1925 | Gullong | 40/663 |
| 1,584,851 | A * | 5/1926 | Crone | 411/22 |

(Continued)

FOREIGN PATENT DOCUMENTS

| | | |
|---|---|---|
| DE | 342387 | 10/1921 |
| DE | 39 04 535 | 8/1990 |
| DE | 9411368.8 | 10/1994 |
| EP | 0 258 491 | 3/1988 |

(Continued)

*Primary Examiner*—Chuck Y. Mah
(74) *Attorney, Agent, or Firm*—Eugene LeDonne; Joseph W. Treloar; Frommer Lawrence & Haug LLP

(57) ABSTRACT

The description is directed to a snap fastening for fast mounting of fittings such as socket wrench latches, swivel lever latches, hinge parts in openings in a thin wall, comprising a head part which is to be arranged on one, outer side of the thin wall and which overlaps the outer rim of the opening, and a body part which proceeds from the head part and projects through the opening in the mounted position, and holding elements which project from the body part and are flexible in direction of its outer surface, the free end of these holding elements being provided with a first inclined surface (run-in bevel) such that the holding element is pushed back in a spring-loaded manner by the opening edge and with a second inclined surface (stop bevel) for supporting the body part without play on the rim or edge of the opening of the other, inner side of the thin wall, which second inclined surface is substantially perpendicular to the first inclined surface. According to the invention, the body part and holding element and spring are separate parts.

40 Claims, 37 Drawing Sheets

U.S. PATENT DOCUMENTS

| | | | | | |
|---|---|---|---|---|---|
| 1,659,992 | A | * | 2/1928 | Crone | 411/342 |
| 3,669,481 | A | * | 6/1972 | Bergmann | 292/49 |
| 4,059,041 | A | * | 11/1977 | Hassan | 411/342 |
| 4,074,941 | A | * | 2/1978 | Jablonski | 403/260 |
| 4,925,351 | A | * | 5/1990 | Fisher | 411/182 |
| 5,435,159 | A | * | 7/1995 | Ramsauer | 70/370 |
| 5,904,462 | A | * | 5/1999 | Gonzalez | 411/342 |

FOREIGN PATENT DOCUMENTS

| | | |
|---|---|---|
| FR | 670715 | 12/1929 |
| FR | 2 746 944 | 10/1997 |
| FR | 2 791 080 | 9/2000 |

* cited by examiner

Fig.63B.
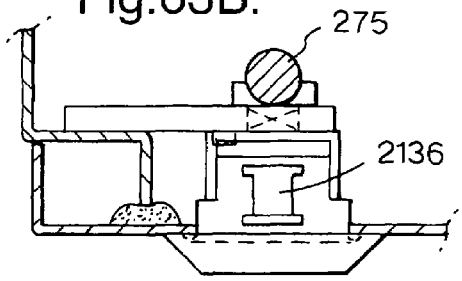
Fig.63C.
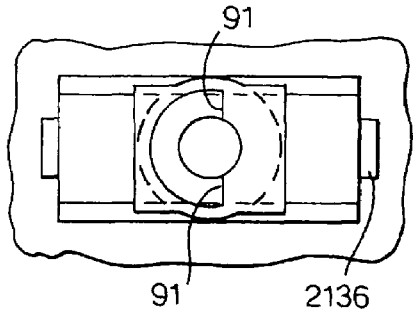
Fig.64A.
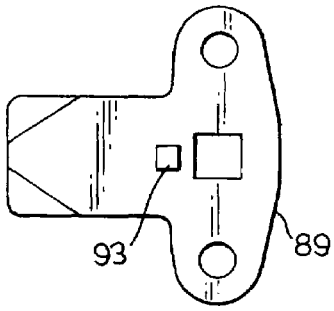
Fig.64B.
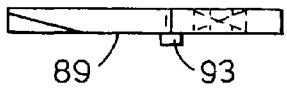
Fig.66A.
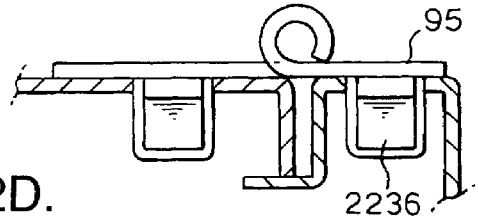
Fig.66B.
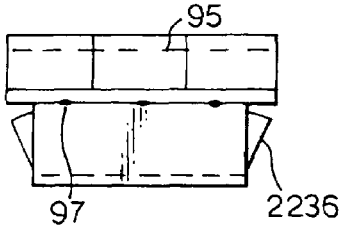
Fig.72D.
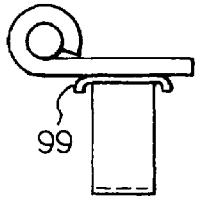
Fig.67B.
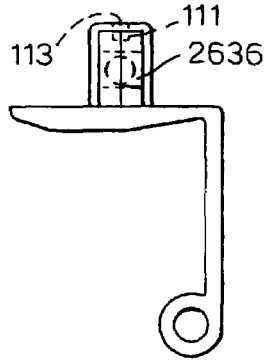
Fig.68A.
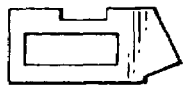
Fig.67A.
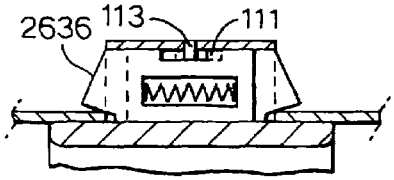
Fig.68B.

Fig.67C.
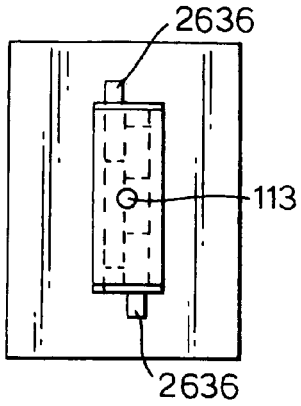
Fig.67D.
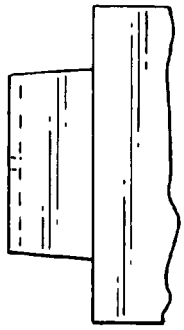
Fig.67E.
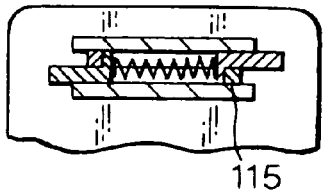
Fig.69A.
Fig.69B.
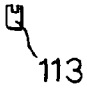
Fig.69C.
Fig.70A.
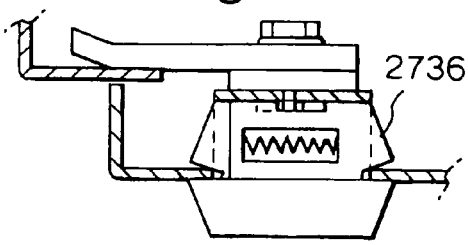
Fig.70B.
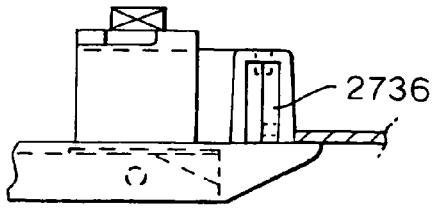
Fig.70C.
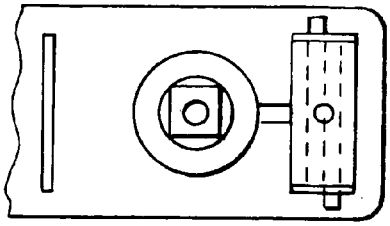
Fig.71A.
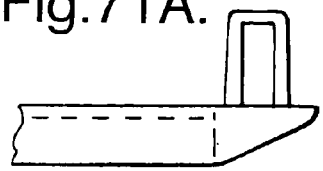

774
723
776
758
736
732
73
270
729
735
733
734
152
741
734
739
750
719
48
751
724
736
744
740
12
716
718
52
46
14
13
785, 781
785, 717
715
783

CLIP FIXTURE FOR THE FAST ASSEMBLY OF FITTINGS, SUCH AS SWIVELING LEVER-TYPE CLOSURES AND HINGE PARTS, IN BREAKTHROUGHS OF A THIN WALL

CROSS-REFERENCE TO RELATED APPLICATIONS

This application claims priority of International Application No. PCT/EP2005/000755, filed Jan. 26, 2005, German Application No. 20 2004 001 161.1, filed Jan. 26, 2004 and German Application No. 20 2004 003 238.4, filed Feb. 27, 2004, the complete disclosures of which are hereby incorporated by reference.

BACKGROUND OF THE INVENTION a) Field of the Invention

The invention is directed to a snap fastening for fast mounting of fittings, such as socket wrench latches, swivel lever latches, hinge parts, in openings in a thin wall, comprising a head part which is to be arranged on one, outer side of the thin wall and which overlaps the outer rim of the opening, and a body part which proceeds from the head part and projects through the opening in the mounted position, and holding elements which project from the body part and are flexible in direction of the outer surface of the body part, the free end of these holding elements being provided with a first inclined surface such that the holding elements (36) can be pushed back in a spring-loaded manner by the opening edge and with a second inclined surface for supporting the body part without play on the rim of the opening of the other, inner side of the thin wall, which second inclined surface is substantially perpendicular to the first inclined surface.

b) Description of the Related Art

U.S. Pat. No. 5,435,159 discloses a snap fastening for quick mounting of a lock housing which can be arranged, for example, in a round opening in a thin wall. The housing which is intended for a sash latch comprises a head part, namely, a flange, which is to be arranged on one, outer side of the thin wall and which overlaps the outer rim of the opening, a body part which projects through the opening in the mounted position proceeds from this head part, and tongue elements which are flexible in the direction of the outer surface of the body part project from the body part and have an inclined surface at their free ends for supporting the body part without play on the rim of the opening of the other, inner side of the thin wall. The holding force of the holding elements or tongue elements which are formed integral with the body part depends upon their spring tension, which depends upon the plastic material that is used, and therefore this holding force cannot be made as high as might be desired.

EP 0258491 A1 discloses a similar construction by which a lock cylinder can be fastened in thin-walled doors, drawers or the like by means of a plastic housing which receives the lock cylinder and which forms holding tongues. By means of inclined surfaces at the ends of the tongues it is possible to adapt in a desirable manner to commonly occurring variations of the structural component parts to be locked. It is also stated in column 9 of the reference that the springing tongues can no longer deflect inward after the lock cylinder is mounted in the housing. This has the disadvantage that a very particular design, namely, a round housing with a lock cylinder inserted therein, must be provided in order to allow the tongues to be locked in this way after mounting.

OBJECT AND SUMMARY OF THE INVENTION

It is the primary object of the invention to provide a snap fastening that does not have these disadvantages.

This object is met in principle in that the body part and holding element and spring are separate parts.

This makes it possible to provide a snap fastening for quick mounting of fittings such as swivel lever latches, hinge parts, cylinder housings, handles, cover plates, and the like in openings in a thin wall for fittings of any shape in principle, that is, not only for round lock cylinders, whose holding force does not depend on the plastic material used for the tongues, can accordingly have any desired magnitude in theory, and can be adapted to the task at hand.

According to a further development, supporting elements are provided in the body part and are held or carried by the latter for supporting the holding elements after the fitting is mounted in the thin wall.

According to another further development of the invention, two holding elements which are arranged diametrically opposite from one another are provided and are supported by spring arrangements such as spiral springs and/or wedge arrangements such as tapered-head screws. Since the spring arrangements can be provided with spring force that, in itself, can be freely selected, the locking force can be adapted to the task at hand and does not depend upon the plastic material.

In the prior art, the locking force depends extensively upon the shape of the fitting and upon the material characteristics of the plastic that is used.

According to a further development of the invention, the holding elements are levers which are arranged at a distance from the thin wall so as to be rotatable around an axis parallel to the plane of the thin wall such as the door leaf plane. Alternatively, the holding elements are levers which are arranged at a distance from the door leaf plane so as to be swivelable around an axis perpendicular to the door leaf plane.

According to another alternative, the holding elements are slides which are arranged so as to be displaceable in a cylinder that lies parallel to the door leaf plane and is rectangular in cross section. These slides are held against the force of a pressure spring by a hook arrangement which locks between the slides themselves or in the cylinder or by a pin.

When the two diametrically oppositely arranged holding elements are loaded to different extents, such as when a sash is used, it is advantageous when the locking part upon which the smaller load is exerted is made of flexible plastic such as polyamide and the other locking part upon which the greater load is exerted is made of metal.

Another embodiment form is characterized in that the holding elements are slides comprising a rigid material such as metal which are arranged so as to be displaceable in a cylinder which is parallel to the door leaf plane and is rectangular in cross section and are held against the force of a pressure spring by a pin arrangement that is arranged between the slides.

The pin arrangement can also comprise screws that are screwed into the head part, and it is possible, according to another embodiment form, for the screws to fasten the body part to the head part.

The cylinder can have a partial dividing wall or undercut or opening edge at which slides are supported axially by a shoulder or hook.

When a dish or trough is provided, the holding elements are advantageously formed by slides which are held in a displaceable manner and whose movement axis lies perpendicular to the longitudinal extension of the trough.

BRIEF DESCRIPTION OF THE DRAWINGS

The invention will be explained more fully in the following with reference to embodiment examples shown in the drawings.

FIGS. 55A to 55D show different views of the lock case according to FIG. 52 which is installed in a wall and with associated cover for the second opening that can be snapped in;

FIGS. 57A to 57C show different views of the associated fastening element;

FIGS. 63A to 63C show three different views of a housing which can be snapped in according to the invention and to which is fitted an adapter for wing tongue application and for mounting round bars;

FIGS. 66A to 66D show different views of a metal hinge with guide channels which are welded on;

FIGS. 67A and 67C show three different views of a hinge according to the invention with a snap fastening;

FIG. 67D shows another view;

FIGS. 68A and 68B show two views of the associated slider;

FIGS. 69A to 69C show the spring, a screw, and a pin as component parts of the fastening device according to FIGS. 76A to D;

FIGS. 70A to 70C show three different views of a fastening element similar to that shown in FIGS. 76A to C, but in this case for a latch;

FIGS. 71A and 71B show detailed views of the latch trough with its fastening device;

FIGS. 78A to 78C show three different views of an embodiment form in which a guide channel is formed through a top that is screwed on;

FIGS. 83A, 83B and 83C show an embodiment form in which the body part is screwed on;

FIGS. 84A, 84B and 84C show different views of an alternative hinge with features according to the invention;

FIGS. 84D, 84E, 84F, 84G show different views of the associated holding element;

FIGS. 84H, 84I show another embodiment form of the holding element;

FIGS. 85A, 85B, 85C and 85D show different views of another hinge part with features according to the invention;

FIGS. 85E, 85F, 85G show detailed views of the associated holding elements;

FIG. 85H is a front view of the T-shape of the holding element;

FIG. 85I shows a sectional top view of an embodiment form with a wedge screw;

FIG. 86A shows an embodiment form with a round opening in a top view in partial section;

FIG. 86B is a bottom view according to FIG. 22A of a hinge part requiring two round openings;

FIG. 86C shows a top view of a hinge part with a round opening and two guide holes;

FIG. 87 shows a view similar to FIG. 21 to illustrate a wedge device in the form of a conical head screw;

FIG. 88 shows a cross-sectional view of the corner area of a switch cabinet with two hinge parts which are fastened by means of a pin or, according to the invention, to the door leaf or to the door frame;

Figure 89:
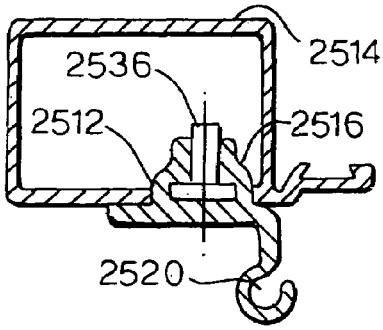
Figure 90A:
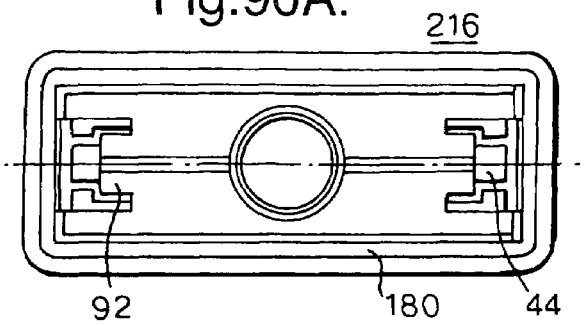
Figure 90B:
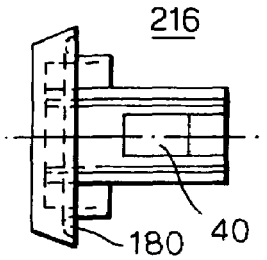
Figure 90C:
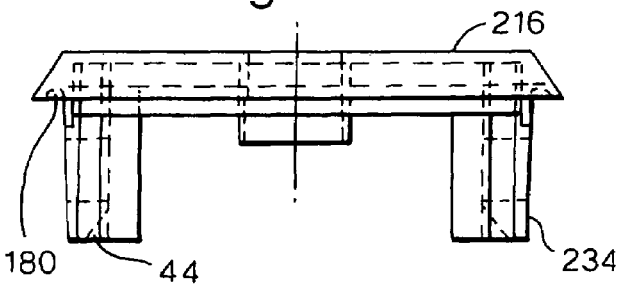
Figure 91A:
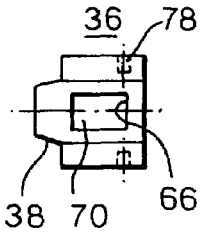
Figure 91B:
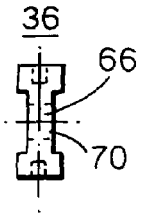
Figure 92A:
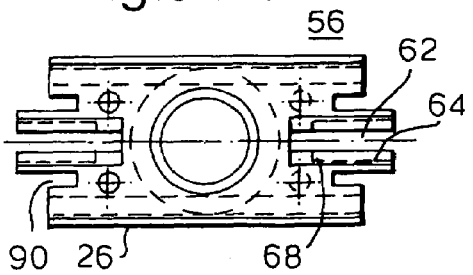
Figure 92B:
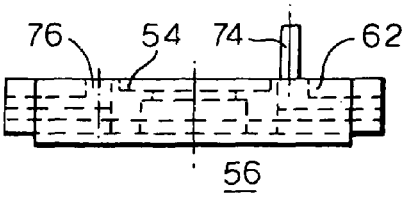
Figure 92C:
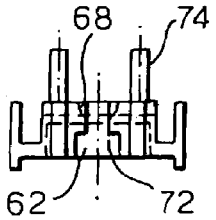
Figure 93A:
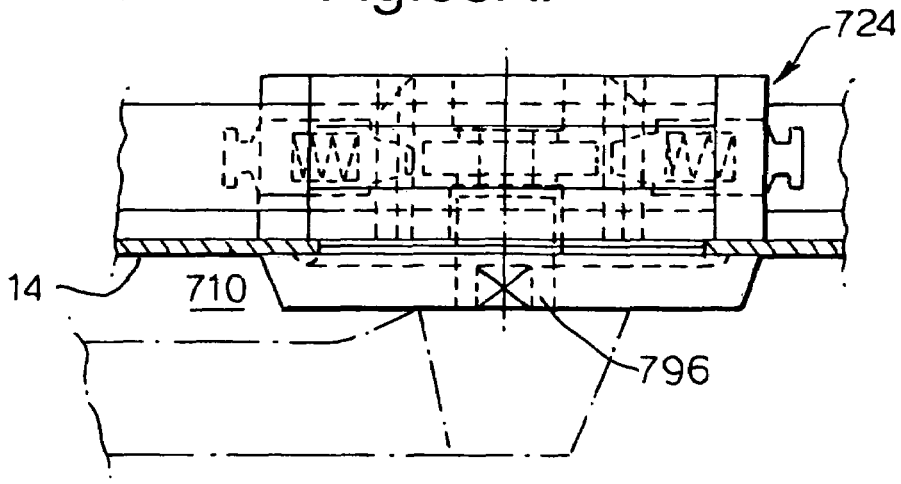
Figure 93B:
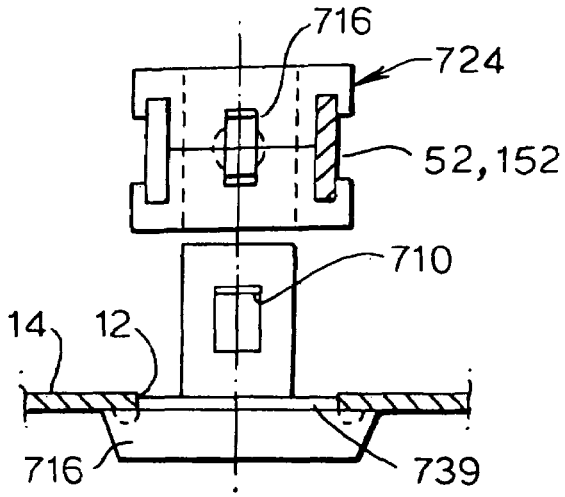
Figure 93C:
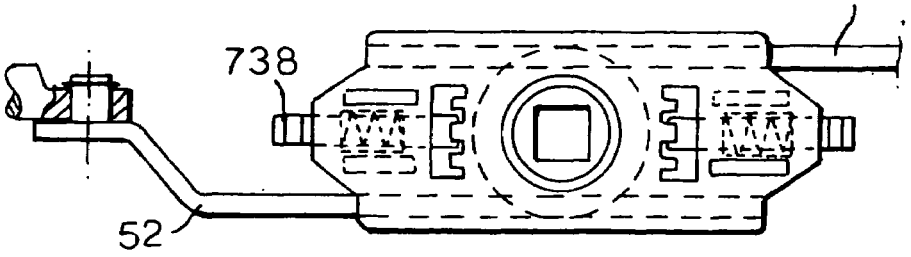
Figures 93D, 93E, 93F, 93G, 93H, 93I:
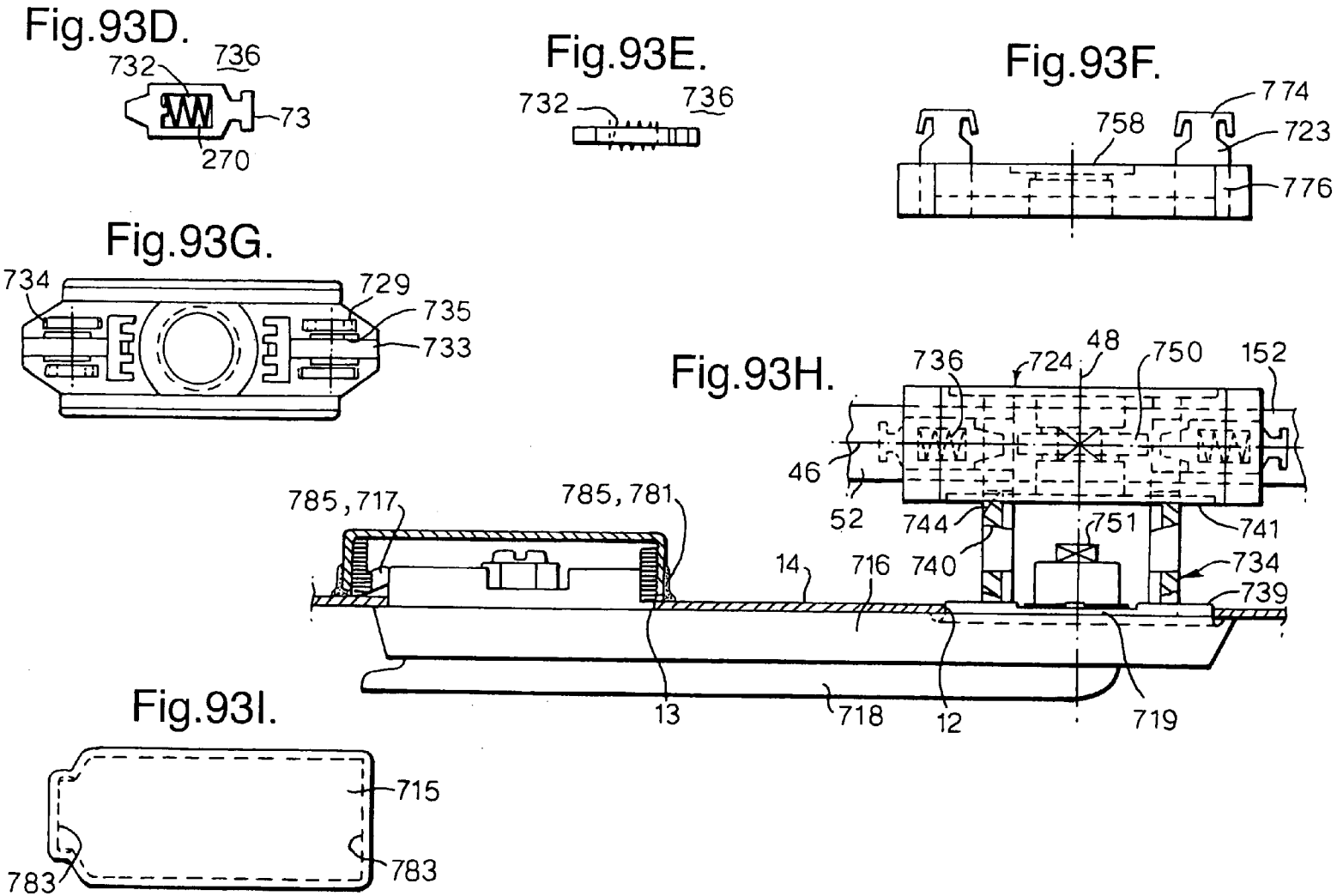
Figure 94A:
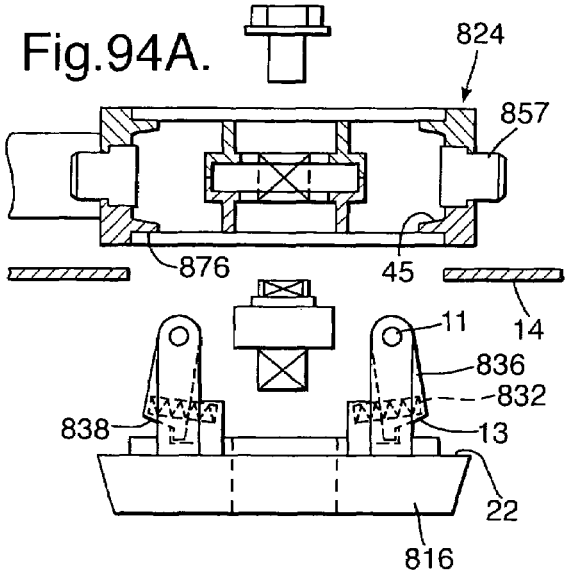
Figure 94B:
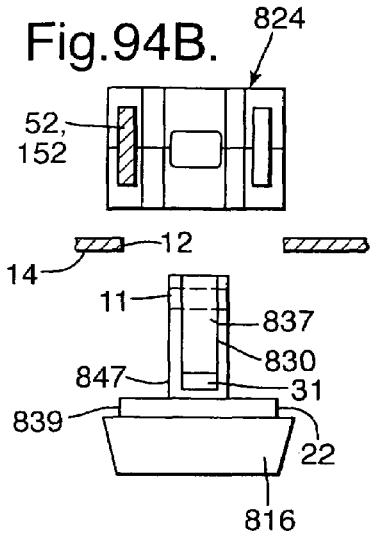
Figure 94C:
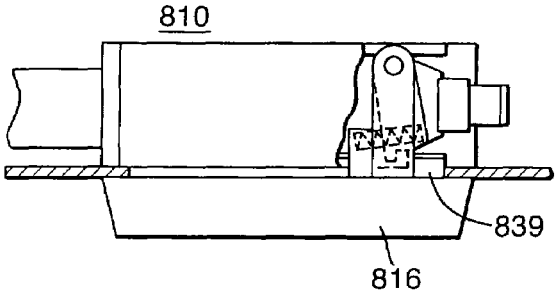
Figure 94D:
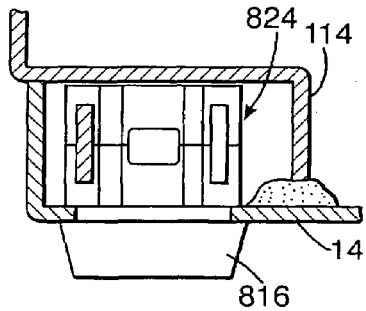
Figure 94E:
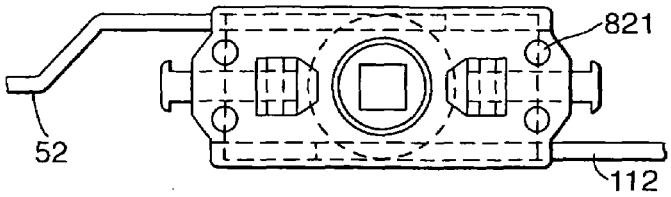

FIG. 89 is a cross-sectional view of a T-shaped snap element made of a pressed aluminum profile;

FIGS. 90A, 90B and 90C show three different views of a short plate as an individual part;

FIGS. 91A and 91B show two views of a double-T-shaped holding element in cross section;

FIGS. 92A, 92B and 92C show three views of one half of the two-part lock case;

FIGS. 93A, 93B, 93C show three views of a lock case according to another embodiment form;

FIGS. 93D and 93E show two views of the associated slide;

FIGS. 93F and 93G show two views of one half of the lock case which is formed by plugging together two identical halves;

FIG. 93H shows a side view of a trough of a swivel lever latch fitting the above-indicated bar lock;

FIGS. 94A and 94B show two different exploded views of the parts of a bar lock with swivelable holding elements or snap elements with unlocking push buttons;

FIGS. 94C and 94D show the bar lock mounted in the opening of a thin wall;

FIG. 94E shows another view of the bar lock with bars; and

FIGS. 95A to 95F show another embodiment form.

DESCRIPTION OF THE PREFERRED EMBODIMENTS

Figure 1A:
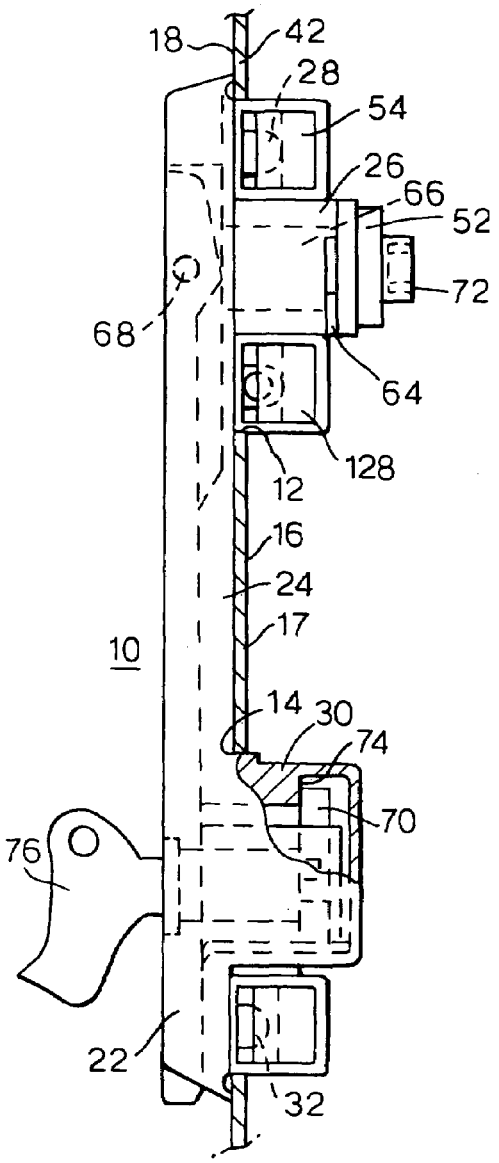
FIG. 1A shows an axial section through a trough for a swivel lever latch in which the snap fastening according to the invention is used.
Figure 27:
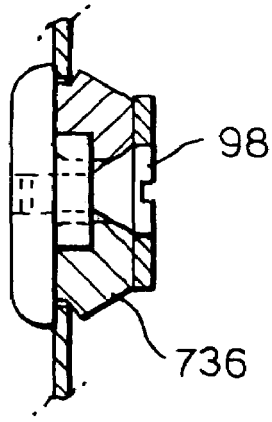
Figure 28:
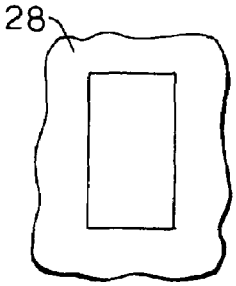
FIG. 28 shows an installation opening in a thin wall which fits the snap devices according to FIGS. 17 to 26.

FIG. 1A shows a longitudinal section through a swivel lever latch 10 as an example of a fastening of a fitting according to the invention. The swivel lever latch 10 is arranged in two rectangular openings 12, 14 of a thin wall 16 which, in the present instance, is part of a sheet-metal cabinet door leaf, see also FIG. 27. When the center web 17 is omitted, a long rectangular opening results. This would also be suitable.

In the area of each opening 12 and 14, the fitting, in this case a swivel lever latch, comprises a head part, in the present case a trough 24, that receives the swivel lever 22. This head part is to be arranged on one, outer side 18 of the thin wall 16 and overlaps the outer rim 20 of the opening 12 and 14, respectively. A body part 26 which projects through the opening 12 and 14, respectively, in the mounted position proceeds from this head part or trough 24. As is shown in FIG. 1C, tongue elements or holding elements 36 which are flexible in direction of the outer surface 34 project from this body part 26, their free ends having an inclined surface 38 for supporting the body part 26, 28 on the rim or edge 40 of the opening 12 and 14, respectively, of the other, inner side 42 of the thin wall 16 without play.

Figure 1B:
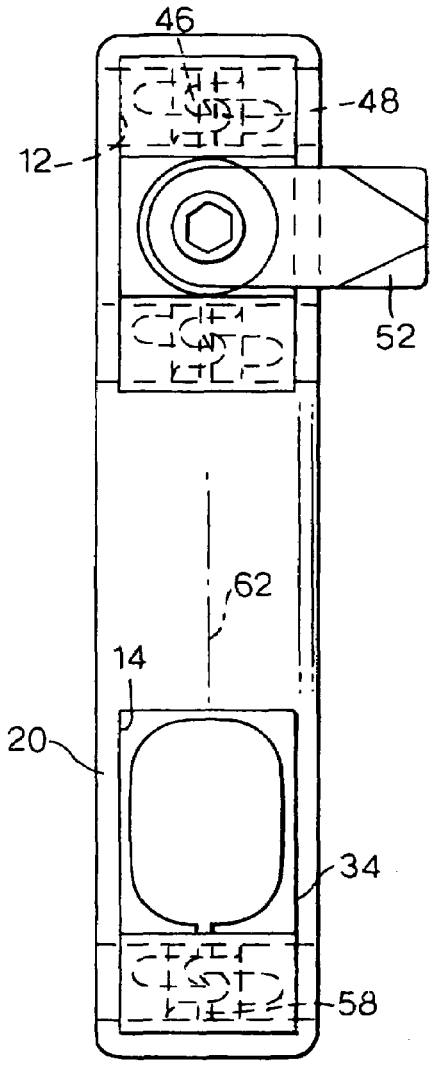
FIG. 1B shows a rear view through the trough which is fastened to the snap fastening according to the invention.

The body parts 28, 32 proceeding from the head part, that is, from the trough 24 in the present instance, have holding elements 36 which are displaceable against any force of a spring 44 in the body part 26. These holding elements are held by locking elements 46, 48 after being mounted in the body part. FIG. 1B shows that the locking elements are hooks which hook in one another. The material of these hooks advisably comprises polyamide, that is, they flexible enough that when the holding elements 36 move linearly in the body part 26, 28 they can deflect to a sufficient degree and move past one another and spring back so as to hook into one another so as to be fastened on the top and bottom with reference to FIG. 1B, so that they remain in the position shown in FIG. 1B, and the body parts 32, 28, 128 proceeding from the trough 24 are accordingly securely held in the associated rectangular opening. This locking can be so designed by means of spring arrangements 44 of corresponding force that the holding elements or snap elements 36 do not move back against the force of the spring 44 under normal circumstances and operating conditions.

When the latch, as in the present case, comprises a sash tongue 52 located behind a door frame bend 50, the two holding elements 36, 136 located diametrically opposite one another are loaded to different degrees. The pressure exerted on the tongue 52 in its position in which it engages from behind is absorbed for the most part by the rim 20 of the sash trough located opposite the holding element 36, while a smaller load is exerted on the holding element 36, whereas on the opposite side the reverse is true because the greatest load is exerted on this holding element 136. In order to take this varying load into account, it can be useful when the snap element 136 bearing the greater load is made of metal and not of plastic. Since, at the same time, the holding element 36 on which the smaller load is exerted is made of a plastic such as polyamide, this holding element remains flexible and is therefore able to move back in a springing manner when the two holding elements 36, 136 move in and lock together.

Figure 1C:
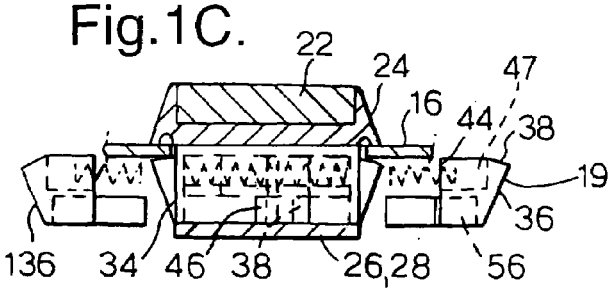
FIG. 1C shows a cross section through the snap fastening for the trough according to FIGS. 1A and 1B.
Figure 1D:
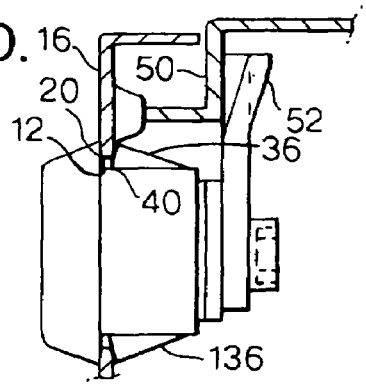
FIG. 1D shows a top view of the trough according to FIGS. 1A and 1B.
Figure 3:
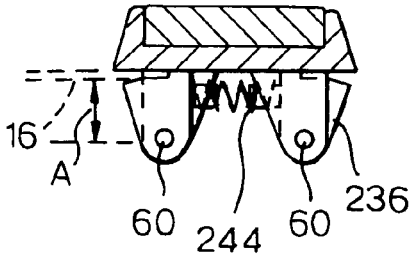
FIG. 3 is a view similar to that in FIG. 1C showing an alternative embodiment form of the snap-like holding element.

In the embodiment form according to FIG. 1C, the two locking parts 36, 136 are slides 56 which are arranged so as to be displaceable parallel to the door leaf plane in a cylinder which is rectangular in cross section, these slides 56 being held against the force of two pressure springs 44 supported at a central wall 58 by a locking hook arrangement 46, 38 which is arranged between these slides 56. In the embodiment form according to FIG. 3, the arrangement is designed in such a way that the holding elements 236 are levers 236 which are arranged at a distance A from the door leaf plane 16 so as to be rotatable around an axis 60 parallel to the door leaf plane.

The two levers 236 are each pressed outward at their inner end by a shared, strong pressure spring 244.

By means of the snap devices, it is possible to mount the lever latch in the thin wall simply by pressing it into two suitably shaped rectangular openings in that edges of the two openings 14, 12 lying in direction of the trough axis 62 press the contacting inclined surfaces of the holding elements 36, 136, 236 inward against the force of the springs 44, 144, 244 when pushing in and allow them to spring back when the inclined surface 38 is reached, thereby securing the trough in the door leaf With regard to the construction of the swivel lever latch, the tongue may be provided with a rotatable cross stop, indicated at 64, in order to switch the swivel lever to right-handed operation or left-handed operation. A bar lock body with pinion and bar stop which is connected to the trough can also be mounted and snapped in, particularly when the center web 17 between the two openings 12, 14 in the thin wall 16 is omitted resulting in an elongated opening comprising the openings 12, 14 (see FIG. 27).

As can be seen from FIGS. 1A and 1B, the top body part 26 projecting from the trough 14 serves as a bearing for a drive shaft 66, the hand lever 22 being articulated at the end of the drive shaft 66 located outside of the door leaf so as to be swivelable around an axis 68 perpendicular to the door leaf plane, while the inner end of the shaft 66 terminates by a square, a tongue 52 having a square opening being mounted on this inner end and held by means of a fastening screw 72.

A holding element 28, 128 adjoins the bearing block for the shaft 68 at the top and/or at the bottom. The holding elements and the bearing block together make up the dimensions for the passage through the rectangular opening in the door leaf.

At the lower end of the trough, a receiving area 30 for a cylinder lock locking part proceeding from the hand lever 22 is provided with an eccentrically moving tongue or cam 70 which can be locked behind an offset surface 74 by actuating a cylinder key 76 in the folded in position.

Alternatively, a spring engaging element 174 can be provided so that a folding in movement and locking can be carried out when the key is removed, and the rotating tongue 170 could also be mountable on the cylinder roller so as to be rigid against rotation by means of the snap devices.

FIG. 4 and the following figures show an embodiment form in which the snap fastening according to the invention is applied in a hinge. FIGS. 4A and 4D, for example, show a two-part hinge with hinge parts 80, 82. The bottom, first hinge part 80 is fastened to the door frame 250 by the snap element 228 which is described in connection with the swivel lever handle, while the second, top hinge part 82 is connected to the door leaf by means of the holding element 236 (see FIG. 4D).

The bottom hinge part 80 and the top hinge part 82 are connected to one another by a hinge pin 84 which is securely press-fitted in the bottom hinge part 80, while its top end is received in a bore hole 86 of the top hinge part 82 so as to be rotatable. The bottom hinge part 80 is connected to a door frame 150, namely by means of a snap fastening 228, while the top hinge part 82 holds a sheet-metal door 216 by means of the snap fastening 232 such that it is swivelable around the axis of the hinge pin 84.

Figure 13:
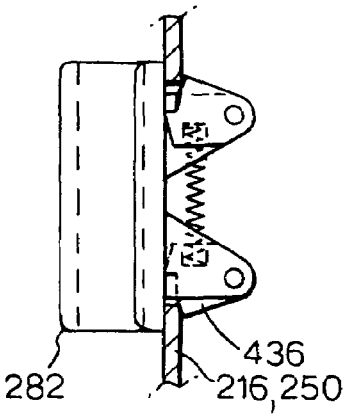
FIGS. 13 and 14 show two views of a hinge with an alternative snap device.

The rectangular opening required in the door frame 250 and in the door leaf 216 for this purpose is shown, for example, in FIG. 13 by reference number 78. In this case also, the snap fastening comprises a head part or hinge tab 88 which is to be arranged on the outer side of the thin wall or of the frame 250 and door leaf device 216 and overlaps the outer rim of the opening 78. A body part 228 which projects through the opening 78 in the mounted position proceeds from this head part or hinge tab 88. Holding elements or tongue elements 336 project from the body part 228 and are flexible in direction of its outer surface, an inclined surface 38 being arranged at their free ends for supporting the body part 228 and, therefore, the hinge 80 without play on the rim of the opening 78 of the other, inner side of the thin wall 250. This also applies to the hinge part 82 and the door leaf 216.

Figure 5A:
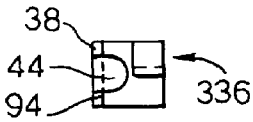
FIGS. 5A, 5B and 5C show different views of the holding elements used in the embodiment form according to FIG. 4A.
Figure 4D:
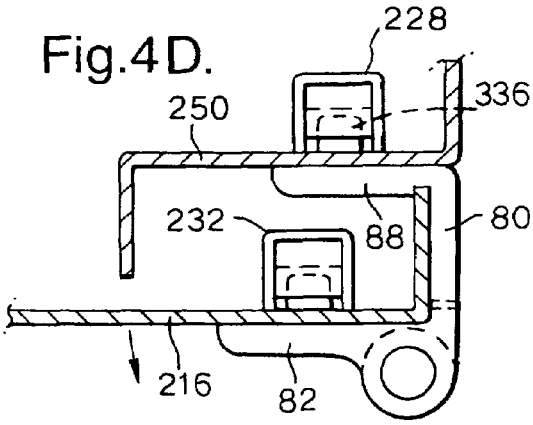
FIG. 4D shows the two hinge parts of FIG. 4A with the snap fastening for use in a cabinet of sheet metal material.
Figure 5B:
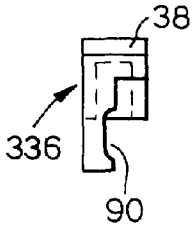
Figure 5C:
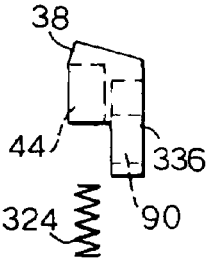
Figure 6:
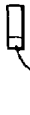
FIG. 6 shows the holding pin which is used in the holding elements according to FIG. 5.
Figure 7A:
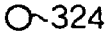
FIGS. 7A and 7B show two different views of the springs, two of these springs being used in the snap device.
Figure 7B:
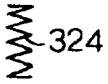

A design such as was already described in connection with the swivel lever latch or such as that shown in the embodiment form according to FIGS. 5A to 5C can be selected for fastening the hinge. In this case, a pin according to FIG. 6 is used for locking instead of the hooks. Two structural component parts made of metal according to FIGS. 5A to 5C are inserted into a rectangular guide channel according to FIG. 8B and are held in the inserted position in such a way by means of a pin, according to FIG. 6, which is screwed in from the outside, that these structural component parts can move relative to one another by a short distance but cannot fall out. This is achieved by means of the offset 90, which provides a path along which one half of the width of the pin 92 can run, and by the spiral spring 344 which is supported in an opening 94 of the part 336 on one side and on an intermediate wall 358 on the other side. The part 336 is shaped symmetrically such that it permits the mounting possibility according to FIGS. 8A and 8B.

Figure 9A:
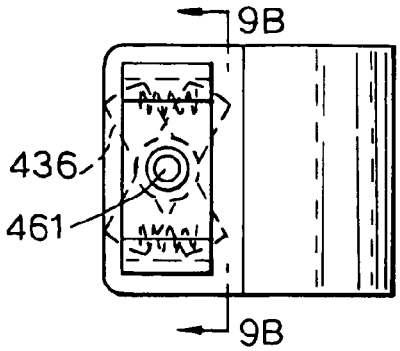
FIGS. 9A, 9B and 9C show three different views of an alternative embodiment form of a hinge device which can be partly snapped in and partly welded.
Figure 9B:
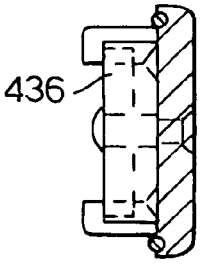
Figure 9C:
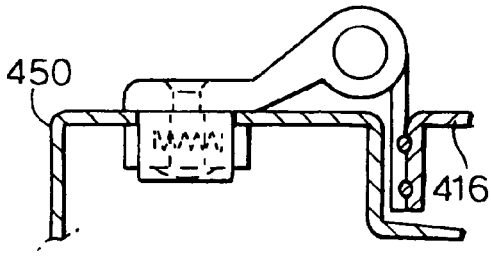

FIGS. 9A, 9B and 9C show an embodiment form for a hinge in which one hinge part is welded to the door leaf 416, while the other hinge part is held at the door frame 450 with another embodiment form of the snap fastening according to the invention. The latter comprises lever devices 436 which are arranged at a distance from the door leaf plane so as to be rotatable around an axis perpendicular to the door leaf plane and which are pressed outward by spring devices and then engage rim areas of a rectangular opening arranged in the door leaf 450.

Figure 10A:
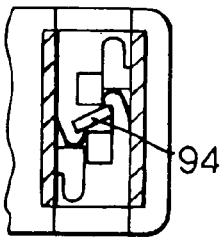
FIGS. 10A and 10B show different views of another embodiment form.
Figure 10B:
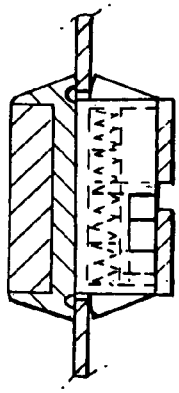
Figure 11:
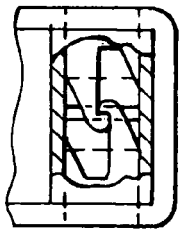
FIG. 11 shows another embodiment form.
Figure 4A:
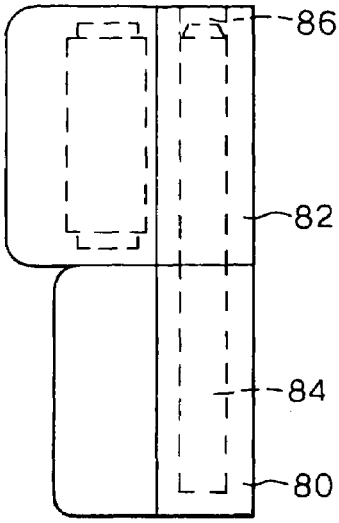
FIG. 4A is a top view of a hinge provided with the snap fastening according to the invention.
Figure 4B:
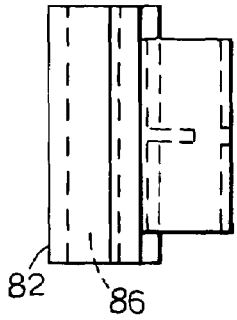
FIG. 4B shows the upper hinge part from FIG. 4A with details of the snap device of the hinge according to FIG. 4A.
Figure 4C:
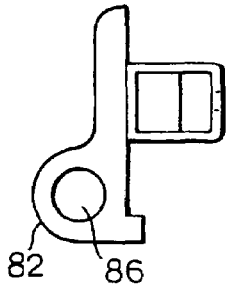
FIG. 4C is a top view of the hinge part according to FIG. 4B.

FIGS. 10A and 10B show an embodiment form in which the two holding elements which can be pressed apart by spring devices are held relative to one another by hooks between which a diagonally positioned wedge 94 is arranged. FIG. 11 shows a similar construction.

Figure 12:
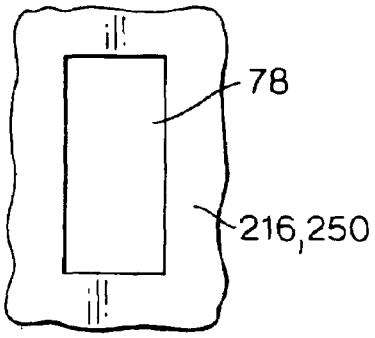
FIG. 12 shows an opening in which a hinge with snap device, e.g., according to FIGS. 13 and 14, can be installed.

A round pin 294 by which two parts comprising a hard material such as metal which are displaceable relative to one another are held in position is provided in FIG. 12.

Figure 14:
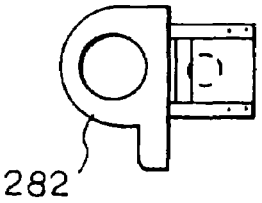

FIG. 13 shows a rectangular opening 78 which is suitable for locking in the construction described in this example. A hinge element, as is shown in a side view and a front view in FIGS. 14A and 14B, could be snapped into this rectangular opening 78. In other respects, the construction is similar to that shown in FIG. 3, although the present instance is directed to a (top) hinge part 282.

Figure 15A:
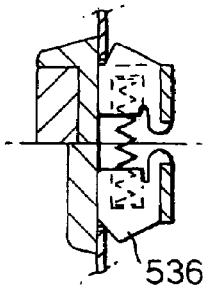
FIG. 15A shows a cross section through a fastening for a swivel lever latch in the upper part of the drawing and for a hinge part in the bottom part of the drawing.
Figure 15B:
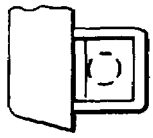
FIG. 15B is a top view of the arrangement according to FIG. 15A.

FIGS. 15A, 15B, 16 and 17 show a fastening in which a swivel lever, in the top half of FIG. 15A, and a hinge lever, in the bottom half of FIG. 15A, can be fastened in a rectangular opening of a thin wall. In this instance, an individual spring is provided which presses the two holding elements 536 out of the pressed back snap-in position, shown in FIG. 17, into the snapped in position according to FIG. 16 when the structural component part or fitting is pressed into the installation opening.

Figure 18A:
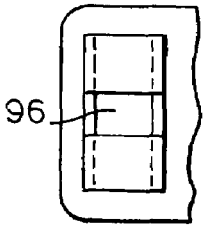
FIGS. 18A and 18B show two views of the channel for holding elements of the hinge tab.
Figure 18B:
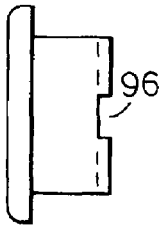
Figure 19A:
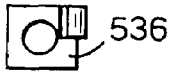
FIGS. 19A and 19B show two views of the holding element.
Figure 19B:
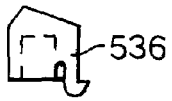
Figure 20:
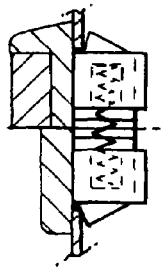
FIG. 20 shows another embodiment form in a view similar to that shown in FIG. 15A.
Figure 21:
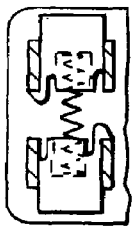
FIG. 21 shows the embodiment form according to FIG. 20 in the snapped in state from the right-hand side.
Figure 22:
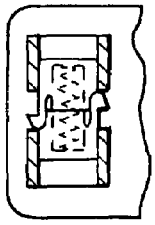
FIG. 22 shows the arrangement according to FIG. 21, but in the pushed back snap-in position.
Figure 23A:
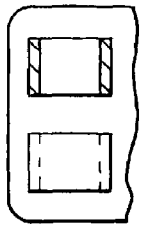
FIGS. 23A and 23B show the arrangement of the channels in the hinge tab according to FIG. 20 in views similar to those in FIGS. 18A, 18B.
Figure 23B:
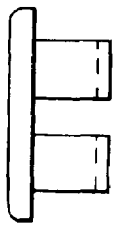
Figure 24A:
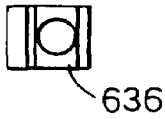
FIGS. 24A and 24B show two views of the associated slide installation holding element.
Figure 24B:
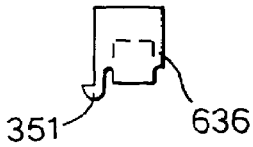

In FIGS. 19A and 19B, the two holding elements 536 are shown in detail in two different views. FIGS. 18A and 18B show the associated individual part as a hinge tab. It is significant that the hook of the holding element 536 is supported at a wall opening 96 in this case. Instead of the solution having the center web and the two springs which was described above, wherein the holding elements are held against one another, the present solution has one spring and an opening at the front in which the snap elements are held by hooks in the assembled delivered state. In the embodiment form shown in FIGS. 20, 21, 22, 23A, 23B, 24A, 24B, which is similar to the embodiment form according to FIGS. 15 to 19, a lateral opening is provided in the holding channel or guide channel instead of a front opening. The advantage in both cases consists in that only one spring is required.

Figure 16:
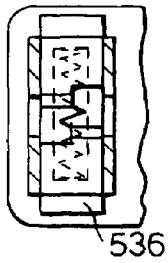
FIG. 16 is a view from the right-hand side of the object shown in FIG. 15A in the snapped in state.
Figure 17:
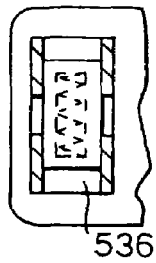
FIG. 17 shows the arrangement according to FIG. 16, but in the pushed back snap-in position.
Figure 26:
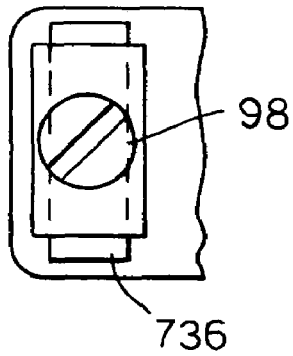
FIGS. 26 and 27 show two views of an embodiment form with tapered-head screw.

FIGS. 16, 20A and 26B show two different views of an embodiment form in which two holding elements 736 are pressed apart by the conical screw 98 resulting in a particularly strong holding force. The screw head lies on the inner side so that blind fastening is not possible. However, a conical nut could also be tightened by a screw from the outside, which would have the same effect and would, moreover, enable blind mounting.

Figure 25:
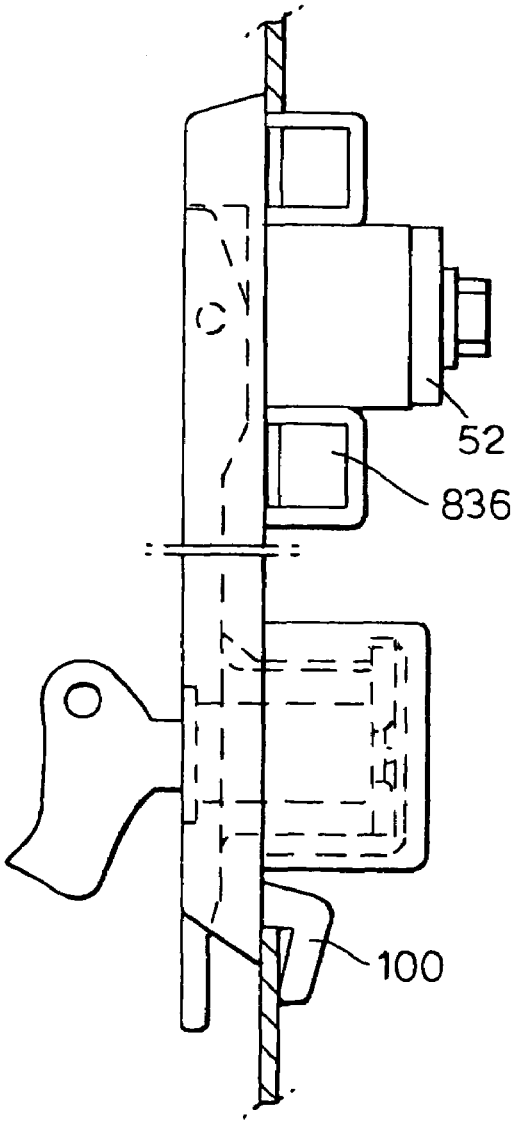
FIG. 25 shows an alternative embodiment form for a swivel lever latch in which only the top part is fastened with the snap device according to the invention, but the bottom part is fastened with a hook.

FIG. 25 shows a swivel lever with a hook fastening, known per se, which is arranged at the bottom end. However, holding elements according to the invention are provided at the top end. Since only small forces act at the bottom end, referring to FIG. 25, a hook fastening by means of hooks 100 is sufficient, whereas in the tongue area 52, where the closing forces and the rotation of the hand lever bring about greater forces, the arrangement 836 according to the invention is provided in any of the above-mentioned embodiment forms, especially the embodiment form using conical screws (FIGS. 26A, 26B).

In this way, the optimal type of fastening can be selected depending on the load.

Figure 29:
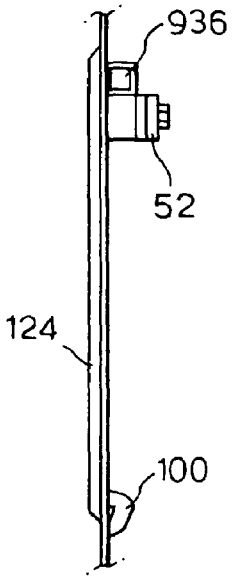
FIG. 29 is a side view of an embodiment form showing an escutcheon or key plate with pin actuation which can be fastened by means of a hook instead of a swivel lever latch according to FIG. 25.
Figure 30:
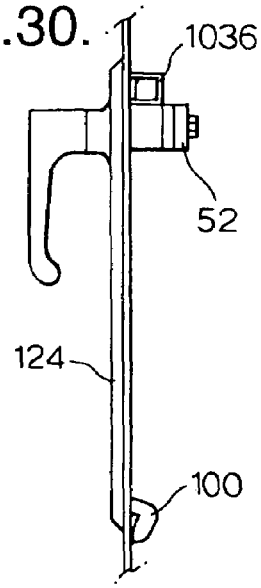
FIG. 30 is a view similar to that in FIG. 29 showing an arrangement with a handle lever actuation which is fastened by only one snap element at one end and by a hook at the other end.

While a top end is secured by two holding elements 836 in the swivel lever latch according to FIG. 25, only one holding element 1036 of this kind is provided in the embodiment forms according to FIG. 29 and FIG. 30.

In FIG. 25, a hook 100 is located at the other end of the escutcheon or head part 24. The embodiment form according to FIG. 29 shows a socket wrench latch, and the embodiment form according to FIG. 30 shows a lever latch.

Figure 31A:
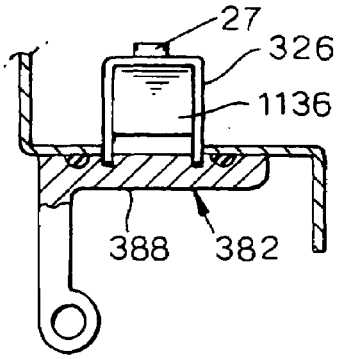
FIGS. 31A to 31C show different views of a fastening according to the invention for a hinge element, wherein the head part and body part are two pieces and are held together by screws.

FIG. 31A shows a sectional top view of a hinge part 382 in which the body part 326 is fastened to the tab 388 forming the head part by means of head screws 27. At the same time, these screws 27 define the lift of the fastening elements 1136 (see elongated hole 29) within which the screw cross section 27 can move.

Figure 31B:
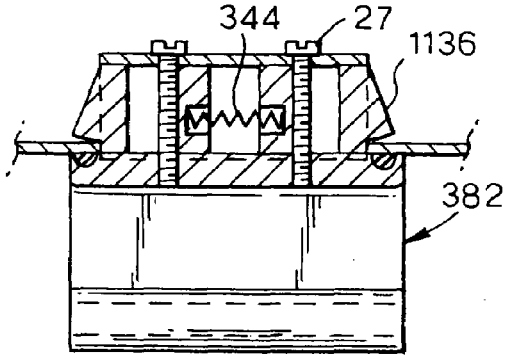
Figure 31C:
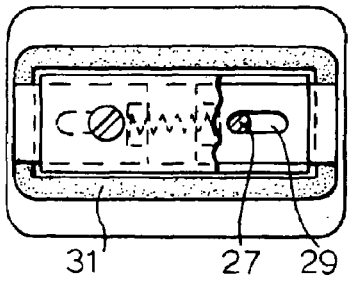

As follows from FIG. 31B or 31C, which show a bottom view in axial section, the elements 1136 move inward in the channel against the force of the spring 344 when inserting insofar as permitted by the elongated hole extension 29 and then jump again into the locking position shown in FIG. 31B. This separation of the head part and body part of the fastening system is advantageous, for example, when grooves 31 are to be provided for sealing rings 33. As a result of this, the tools for the injection molding process can be difficult to manage when it is desirable to manufacture a one-piece construction.

Figure 32A:
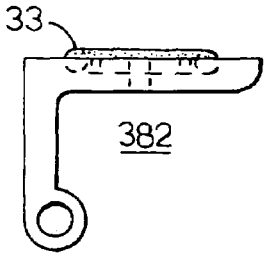
FIGS. 32A to 32C show three different views of the head part of the hinge element.
Figure 32B:
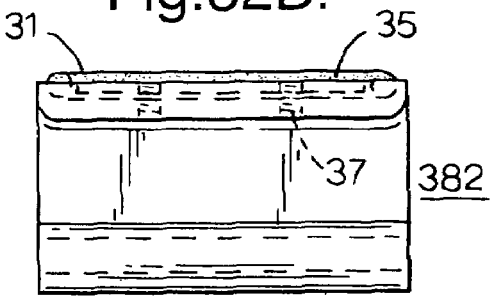
Figure 32C:
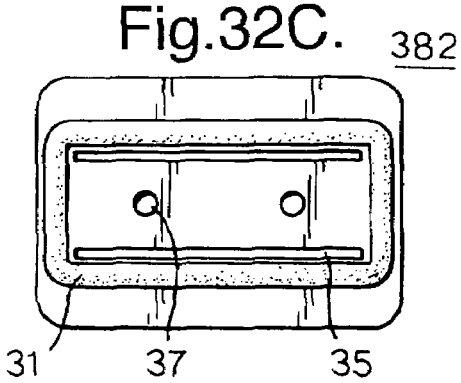
Figure 33A:
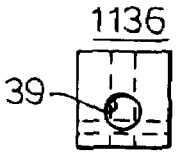
FIGS. 33A to 33C show three different views of the holding element used in this case.
Figure 33B:
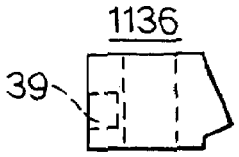
Figure 33C:
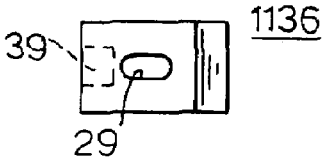
Figure 33D:
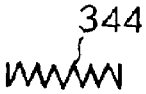
FIG. 33D shows the associated spiral pressure spring.

The hinge part 82 is shown in detail in FIGS. 32A, 32B and 32C in three different views. The drawings also show the groove 35 into which the free legs of the U-part 326 are inserted, as well as the threaded bore holes 37 into which the screws 27 can be screwed. The holding element which is used here is shown as an individual part in FIGS. 33A to 33C, including the receiving blind hole 39 for receiving a pressure spring 44.

Figure 34:
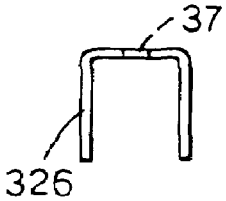
FIGS. 34 and 35 show two views of the U-shaped body part of the arrangement according to FIGS. 31A to 31C.
Figure 35:
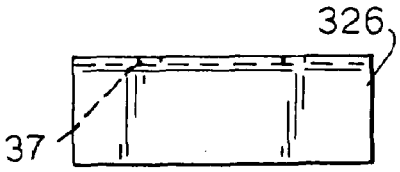

The guide part for the holding elements 1136 is shown in a front view and in a side view in FIGS. 34A and 34B.

Figure 36A:
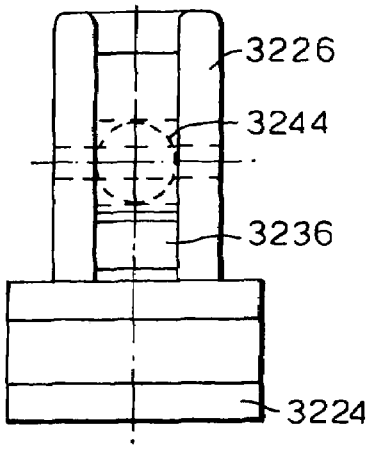
FIG. 36A shows a side view of a snap element arrangement with diagonal slot guide in the pushed back position during the mounting process.
Figure 36D:
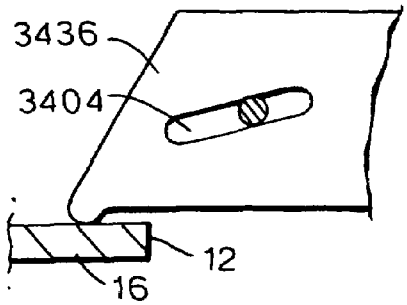
FIG. 36D shows an embodiment form in which the clamping forces are transmitted to the sheet metal at a greater distance from the opening rim.
Figure 36E:
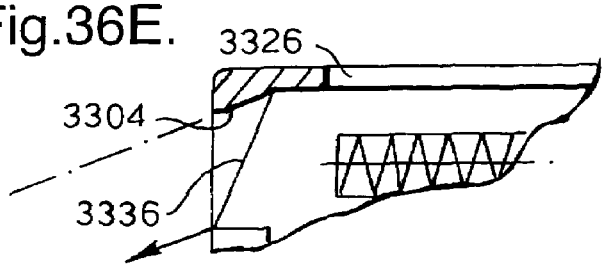
FIG. 36E shows a front view of an alternative embodiment form in which the diagonal slot guide is replaced by an inclined surface guide.
Figure 36B:
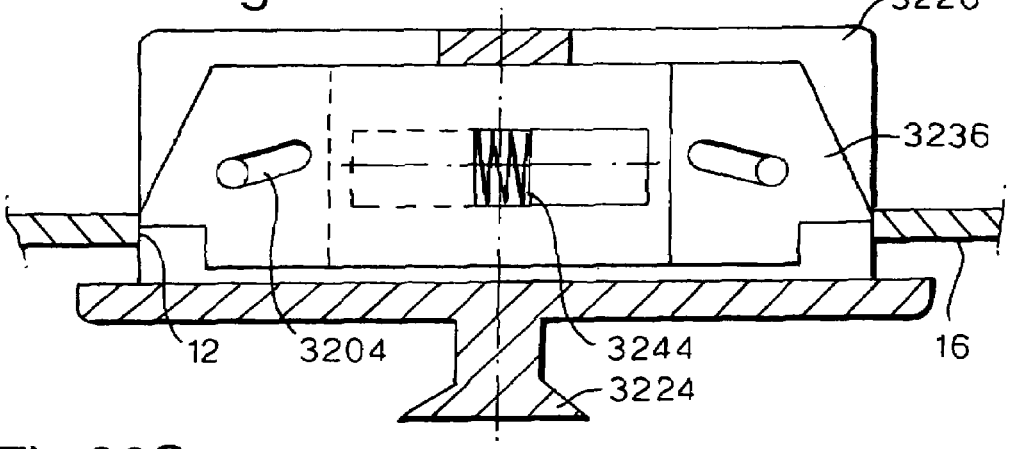
FIG. 36B shows a front view of the snap element arrangement with diagonal slot guide in the pushed back position during the mounting process
Figure 36C:
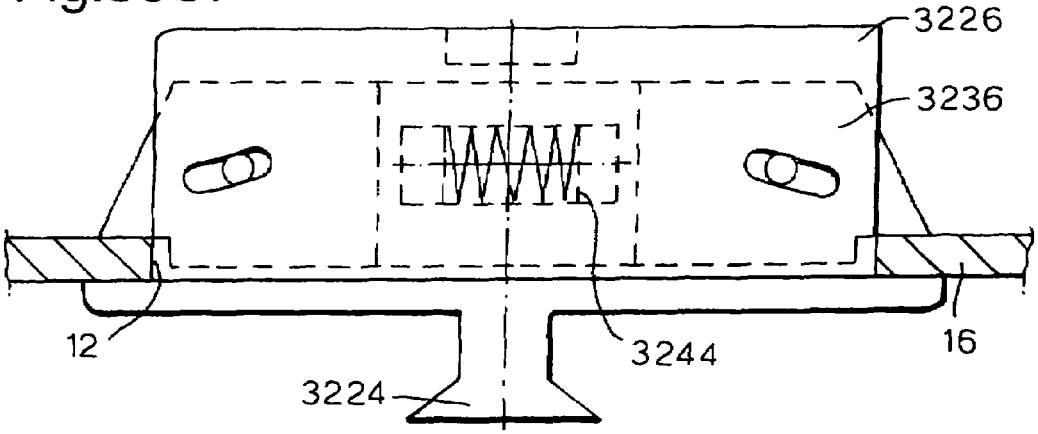
FIG. 36C shows the front view corresponding to FIG. 36B, but after completed assembly.

As a possible alternative for generating clamping action, FIG. 36A shows a side view and FIG. 36B shows a front view of a snap element arrangement 3236 with diagonal slot guide 3204 in the pushed back position during the mounting process. FIG. 36C shows a front view corresponding to FIG. 36B, but after completed assembly. In this case and in the following figures, the last two digits of the reference numbers correspond in meaning to those already indicated in the preceding.

FIG. 36D shows an embodiment form in which the clamping forces are transmitted to the sheet metal 16 at a greater distance from the opening rim 12. This allows larger forces to be absorbed by the sheet metal.

FIG. 36E shows a front view of an alternative embodiment form in which the diagonal slot guide is replaced by an inclined surface guide 3304.

Figure 37A:
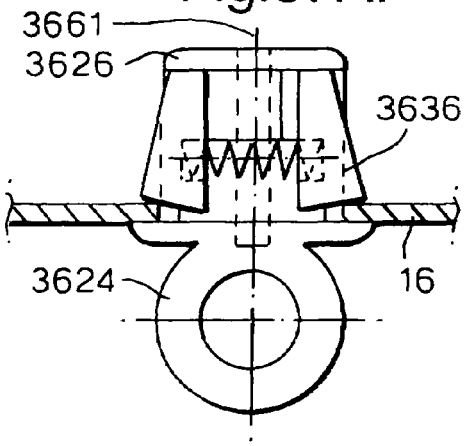
FIGS. 37A and 37B show a side view and a top view of an embodiment form with lever-shaped crosswise spring-mounted holding elements, see also FIGS. 9A to 9C.
Figure 37B:
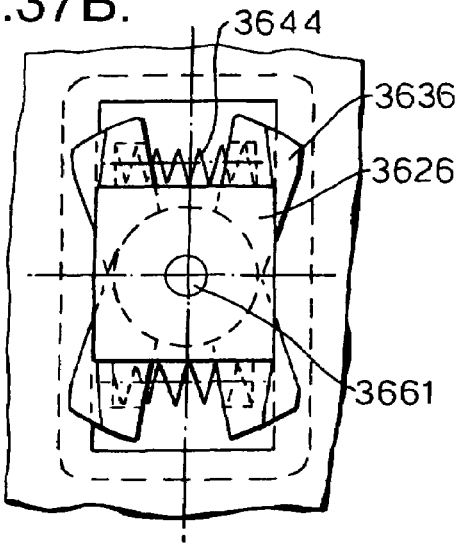

FIGS. 37A and 37B show a side view and a top view of an embodiment form with lever-shaped holding elements 3636 which are spring-mounted (3644) in a crosswise manner and which are swivelable around an axis 3661 extending perpendicular to the wall plane 16, see also FIGS. 9A to 9C.

Figure 38A:
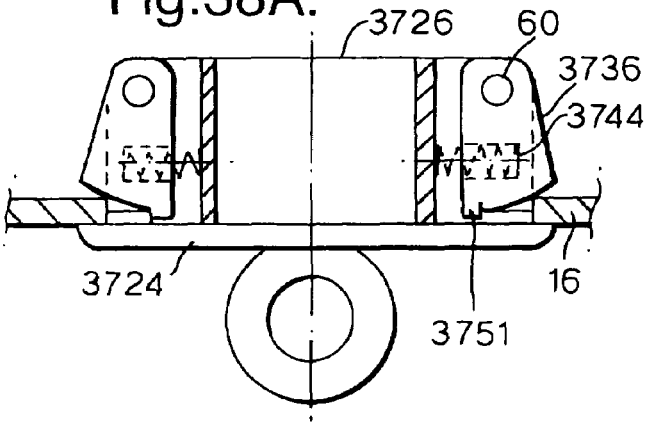
FIGS. 38A and 38B show a front view and a side view of holding elements or snap elements which are mounted at the front end or front side, guided in an arc, and spring-mounted per se.
Figure 38B:
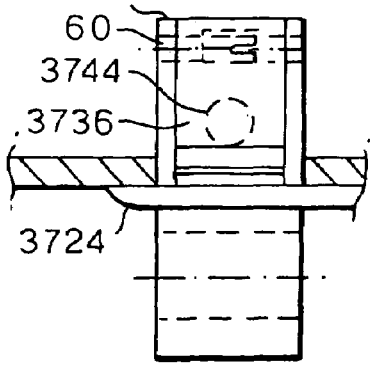

FIGS. 38A and 38B show a front view and a side view of holding elements or snap elements 3736 which are mounted at the front end or front side, guided in an arc around an axis 60 extending parallel to the wall plane 16, and spring-mounted (3744) per se. The fastening of the fitting part 3724 in the center of the opening of the arc path is arranged farther inward, with reference to the center point 60 of the snap element, in order to achieve the clamping function. In this connection, see also FIG. 3.

Figure 39A:
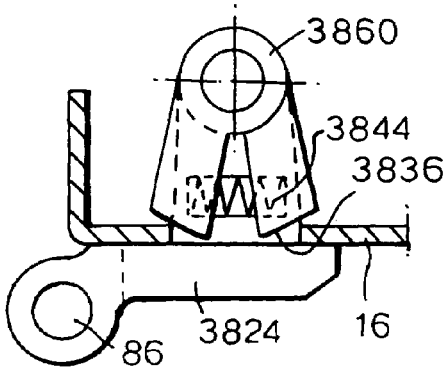
FIGS. 39A and 39B show a side view and a top view of holding elements as in FIGS. 38A, 38B, but in which a plurality of holding elements are mounted successively on a shaft.
Figure 39B:
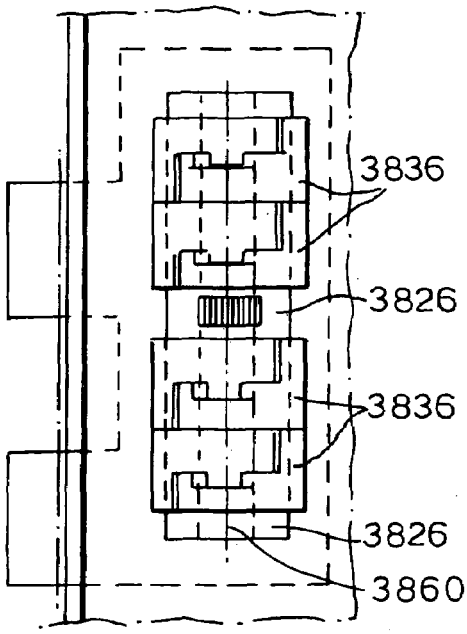

FIGS. 39A and 39B show a side view and a top view of holding elements 3836 as in FIGS. 38A, 38B, but in which a plurality of holding elements 3836 are mounted successively on a shaft 3860. They transmit greater forces. The shaft 3860 is supported at multiple locations (at both ends and in the middle) in the joint part 3826, e.g., in the body part 3826 of a fitting part, e.g., hinge part 3824, as is shown.

Figure 40A:
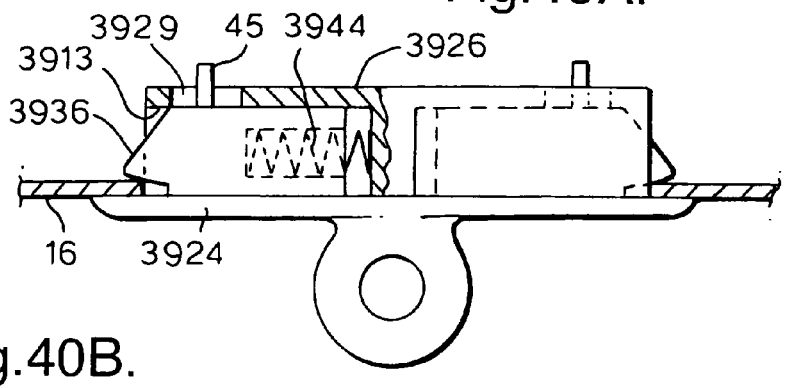
FIGS. 40A to 40C show a front view, a top view, and an exploded view of linearly running, jointly spring-loaded snap elements.
Figure 40B:
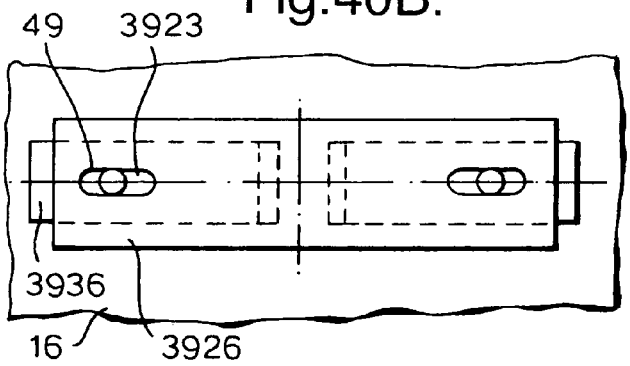
Figure 40C:
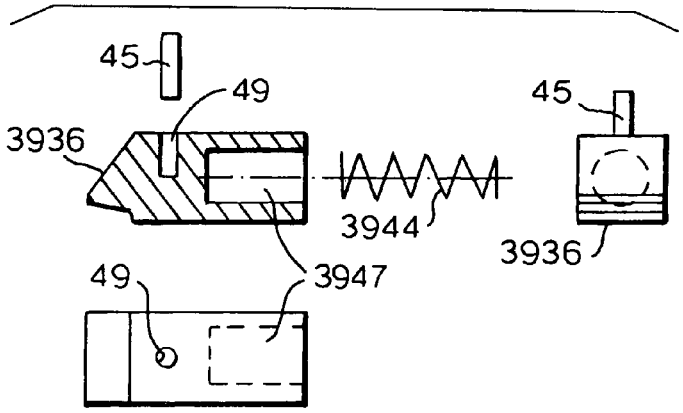

FIGS. 40A to 40C show a front view, a top view, and an exploded view of linearly running, jointly spring-loaded snap elements 3936 with a pin 45 which is guided in a groove 3929 of the body part 3926. After the spring 3944 is inserted into the blind hole 3947 and the holding element 3936 is inserted into the channel 3913 of the body part 3926, the pin 45 is inserted or screwed into the bore hole 49 in order to limit the lift of the holding element.

Figure 8A:
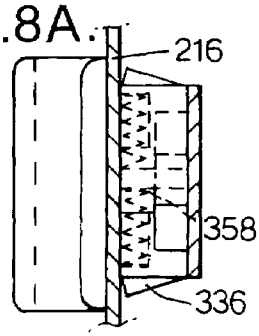
FIGS. 8A and 8B show two different views of the snap device that can be used in the hinge according to FIG. 4A.
Figure 8B:
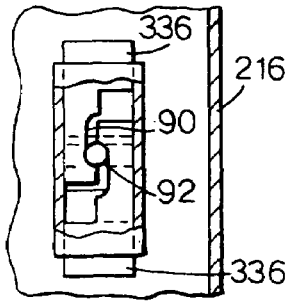
Figure 41A:
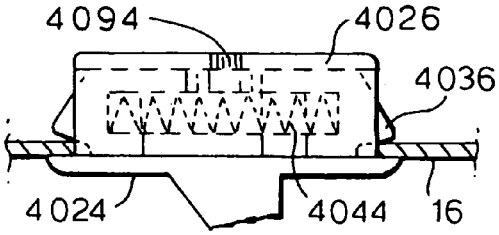
FIGS. 41A and 41B show two views of a snap element which grasps a panel and whose lifting movement is limited by a pin.
Figure 41B:
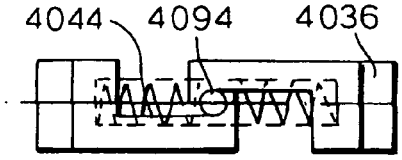

FIGS. 41A and 41B show two views of a snap element 4036 which grasps a panel 16 and whose lifting movement is limited by a pin 4094; see also FIGS. 8A and 8B.

Figure 42A:
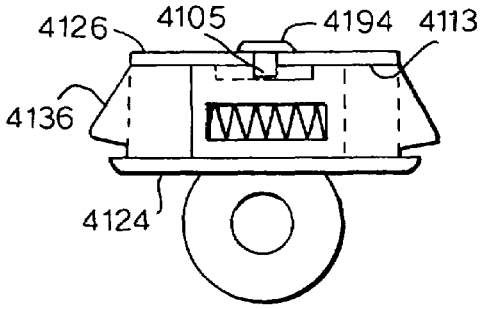
FIG. 42A shows a front view and FIG. 42B shows a side view of a holding element which is secured by a pin and whose lift is limited by the pin, additional views are shown in FIGS. 42C, 42D; this holding element is formed of two opposed spring-mounted elements which have a closed opening when stacked one on top of the other in a mirror-inverted manner for receiving the spring, a spiral pressure spring being biased in this opening; in the mirror-inverted layering, the offset arranged on the longitudinal side forms a groove for receiving a plug whose projection orients the snap element assembly centrally in the channel.
Figure 42B:
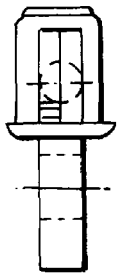
Figure 42C:
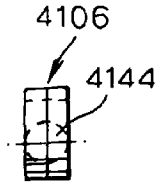
FIG. 42D shows different detailed views of the snap element assembly.
FIGS. 42E and 42F show an embodiment form in which the elements are oriented centrally by bending down a web that is generated by grooves.
Figure 42D:
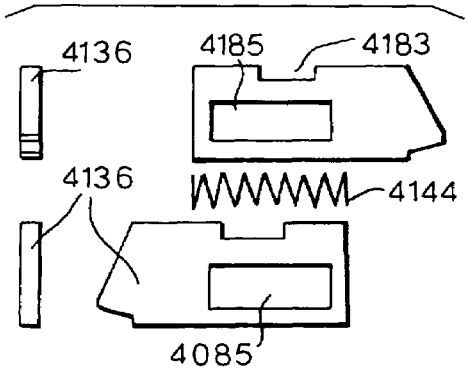

FIG. 42A shows a front view and FIG. 42B shows a side view of a snap fastening with holding elements 4136 which are secured by a pin 4194 and whose lift is limited by the pin 4194; additional views are shown in FIGS. 42C, 42D. These holding elements 4136 are formed of two opposed spring-mounted (4144) elements 4136 which have a closed opening 4185 when stacked one on top of the other in a mirror-inverted manner for receiving the spring, a spiral pressure spring 4144 being biased in this opening 4185. In the mirror-inverted layering, an offset 4183 arranged on the longitudinal side forms a groove for receiving a plug 4194 whose projection 4105 orients the snap element assembly 4106 centrally in the channel 4113. FIG. 42D shows different views of the individual parts 4136 (duplicate) and 4194 of the snap element assembly 4106.

Figure 42E:
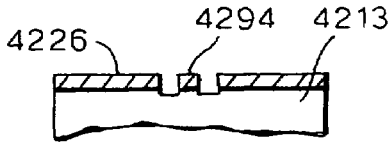
Figure 42F:
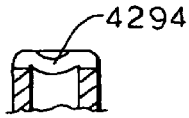

FIGS. 42E and 42F show an embodiment form in which the elements are oriented centrally by bending down a rib or web 4294 that is generated by grooves.

Figure 43A:
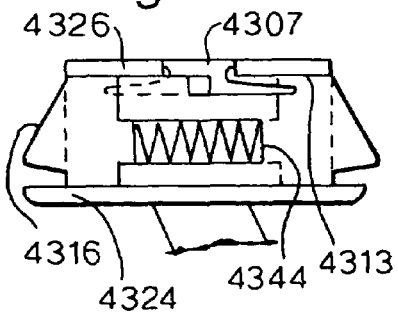
FIG. 43A shows assembled snap elements of thin material provided with an open spring channel, wherein the hook is retained in an outer opening of the channel, and the snap elements are secured against spring pressure.
Figure 43B:
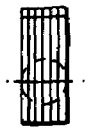
FIG. 43B shows oppositely working assembled snap elements.
Figure 43C:
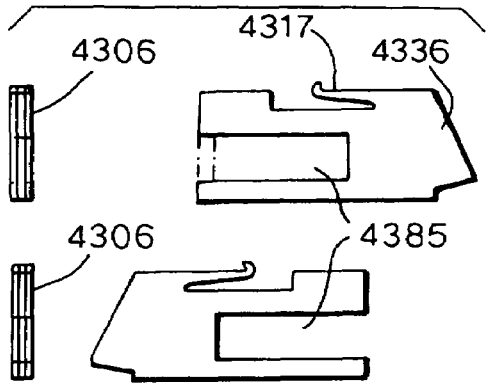
FIG. 43C shows the individual parts of the arrangement in FIGS. 43A and 43B.

FIGS. 43A and 43B show assembled snap elements 4336 of thin material provided with an open spring channel 4385, wherein the hook 4351 is held in an outer opening 4307 of the channel 4313, and the snap elements 4336 are secured against spring pressure 4344. These snap elements are, again, assembled snap elements working in opposite directions. FIG. 43C shows these two individual assemblies 4306 of the arrangement in FIGS. 43A and 43B.

Figure 43D:
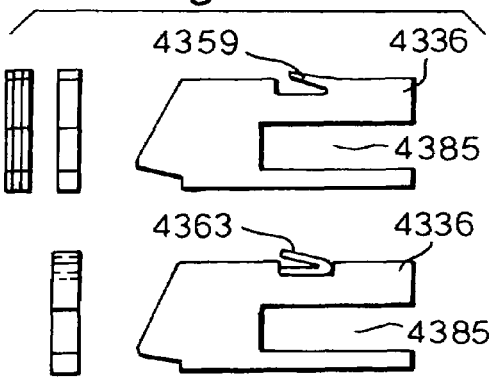
FIG. 43D shows another arrangement for holding the snap elements in their operating position against spring pressure (because the spring channel opens toward the rear)

FIG. 43D shows two other arrangements (a springing protuberance 4359 integral with the plate 4336 and a protuberance part 4363 inserted in an offset of the plate 4336 so as to form two pieces) for holding the snap elements in their operating position against spring pressure (because the spring channel 4385 opens toward the rear).

Figure 43E:
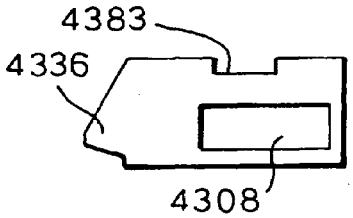
FIGS. 43E to 43G show snap elements with a closed half-shell for receiving the spring; after removing the plug, the snap elements can be pulled back with the blade of a screwdriver or a similar tool (see, e.g., FIG. 81B) for disassembling the fastened part (fitting part, trim panel)
Figure 43F:
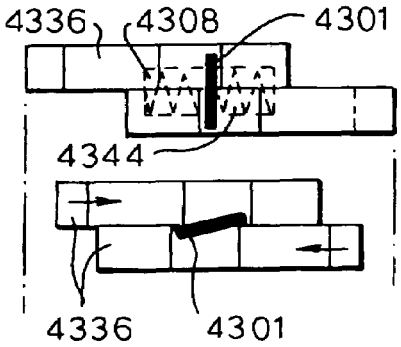
Figure 43G:
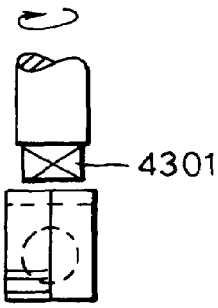

FIGS. 43E to 43G show snap elements 4336 with a closed half-shell 4308 for receiving the spring 4344. After removing the plug (see FIG. 42A), if provided, the snap elements 4336 can be pulled back with the blade of a screwdriver 4301 or a similar tool (see, e.g., FIG. 43G and FIG. 81B) for disassembling the fastened part 4324 (fitting part, trim panel).

Figure 44G:
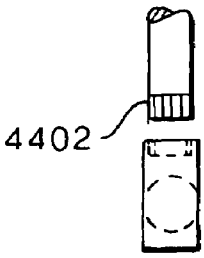
FIG. 44A shows the pulling back of the snap parts with toothed shaft.
FIG. 44B shows a housing of a fastening element for successive mounting of assembled snap elements according to FIG. 43C.
FIG. 44C shows a screwdriver blade.
FIGS. 44D and 44E show snap elements which are arranged side by side with an offset on the longitudinal side for pulling back with the screwdriver according to FIG. 44C, mounted in a fastening element housing.
FIG. 44F shows a top view of snap elements.
Figure 44A:
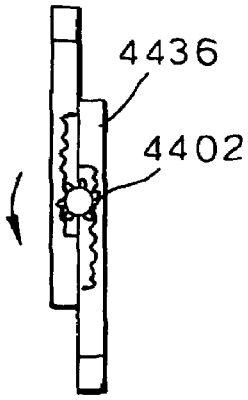

FIG. 44A shows the pulling back of the toothed snap parts 4436 with a toothed shaft 4402.

Figure 44B:
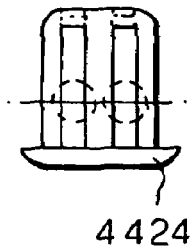
Figure 44C:
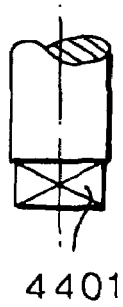
Figure 44D:
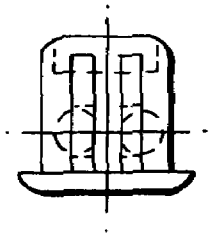
Figure 44E:
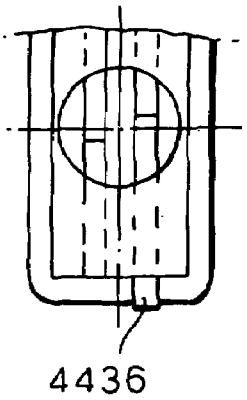
Figure 44F:
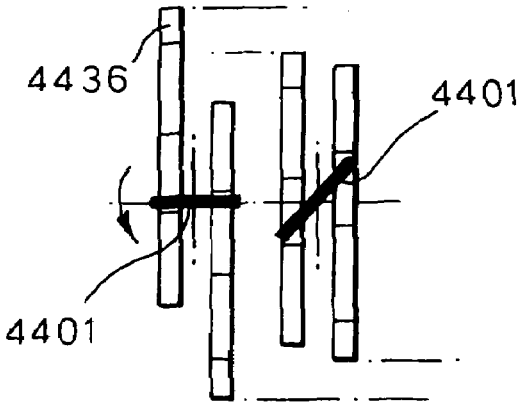

FIG. 44B shows a housing 4424 of a fastening element for successive mounting of assembled snap elements 4336 according to FIG. 43C. FIG. 44C shows a screwdriver blade 4401. FIGS. 44D and 44E show snap elements which are arranged side by side with an offset on the longitudinal side for pulling back with the screwdriver according to FIG. 44C, mounted in a fastening element housing. FIG. 44F shows a top view of the associated snap elements 4436.

Figure 45A:
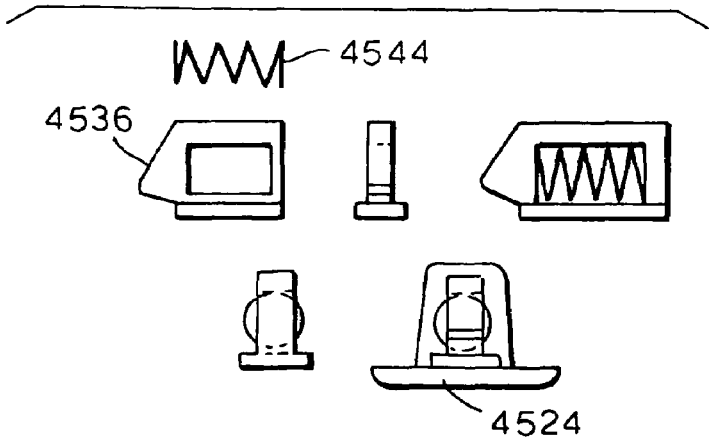
FIG. 45A shows 6 views of individual (not layered) snap elements for inserting individually at front surfaces or side surfaces of fittings or other construction parts, with a T-cross section for improving guide characteristics when using especially short or tall snap elements; the view on the right-hand side is a top view showing application on a front surface; the spring is inserted with biasing.

FIG. 45A shows 6 views of individual (not layered) snap elements 4536 for inserting individually at front surfaces or side surfaces of fittings or other construction parts, with a T-cross section 4503 for improving guide characteristics when using especially short or tall snap elements; the view on the right-hand side is a top view showing front-surface application 4524. The spring 4544 is inserted so as to be biased.

Figure 45B:
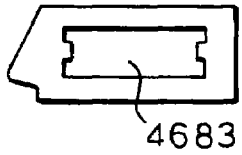
FIG. 45B shows a snap element with a rectangular opening for receiving a spring, front edges of the opening with projections on one side or two sides, spring is held securely for pre-assembly.

FIG. 45B shows a snap element with a rectangular opening 4683 for receiving a spring. Front edges of the opening 4683 are provided with projections on one side or two sides so that the spring is held securely during pre-assembly.

Figure 45C:
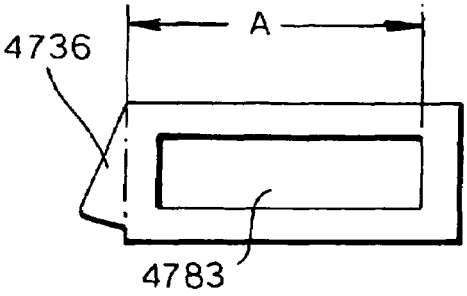
FIG. 45C shows snap element to be used individually; spring can be inserted in the center or on one side (biased)
Figure 45D:
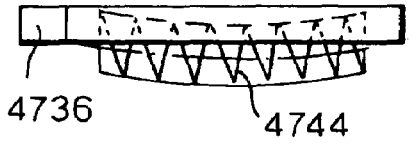
FIG. 45D illustrates the realization that the spring tends to buckle when inserted on one side, and accordingly holds the pre-assembled snap element securely in the mounting space.
Figure 45E:
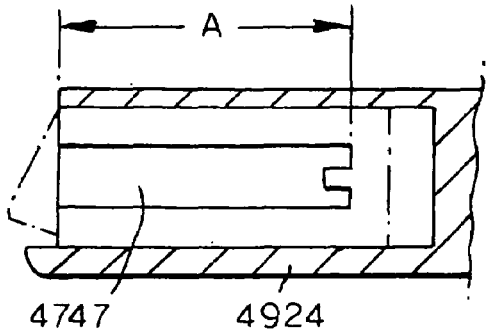
FIG. 45E shows the mounting space for the snap element according to FIG. 45D, the snap element is secured in position by adhering to reference dimension A with the snap element and spring nest in the mounting space of the fitting to be fastened by snaps.

FIG. 45C shows a snap element 4736 to be used individually. The spring 4744 can be inserted (so as to be biased) in the center or on one side (FIG. 45C). FIG. 45D illustrates how the spring 4744 tends to buckle when inserted on one side and accordingly holds the pre-assembled snap element securely in the mounting space. FIG. 45E shows the mounting space 4747 for the snap element 4736 according to FIG. 45D, the snap element 4736 is secured in position by adhering to reference dimension A with the snap element 4736 and spring nest 4747 in the mounting space of the fitting 4724 to be fastened by snaps.

Figure 45F:
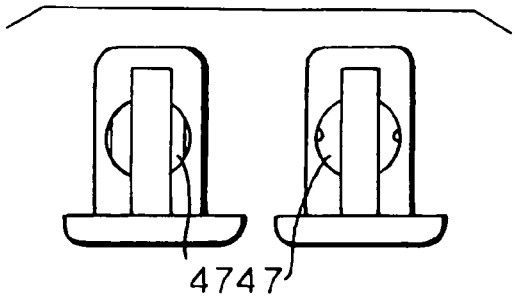
FIG. 45F illustrates the realization that when the spring is arranged in the center in the snap element it is prevented from falling out by the following steps: 1) bore hole for the spring (spring nest) is reduced in the rear area in such a way that the spring jams when the pre-assembled snap element is inserted or; 2) surfaces or tips are arranged whose intermediate size is smaller than the diameter of the spring.

FIG. 45F shows in two illustrations that when the spring is arranged in the center in the snap element it is prevented from falling out by the following steps: either the bore hole for the spring (spring nest 4747) is made smaller in the rear area in such a way that the spring 4744 jams when the pre-assembled snap element is inserted, or surfaces (see illustration on left-hand side of FIG. 45F) or tips (see illustration on right-hand side of FIG. 45F) are arranged whose intermediate size is smaller than the diameter of the spring.

Figure 45G:
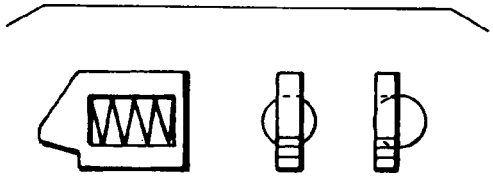
FIG. 45G shows 7 views of snap elements with rectangular cross section, inserted on the front side for snap fastening of a structural component part, spring arrangement in center or at the side.
Figure 46A:
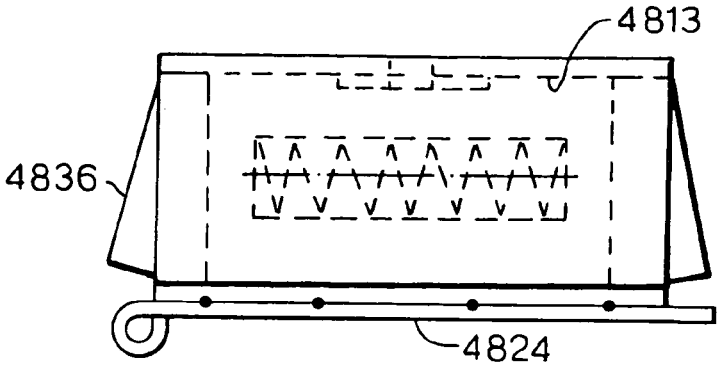
FIGS. 46A and 46B show the creation of a guide channel for snap elements at a sheet-metal part, such as a hinge tab, by tack-welding of a rectangular pipe section.
Figure 46B:
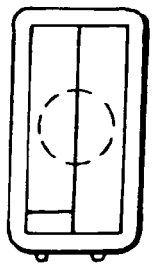

FIG. 45G shows 7 views of snap elements with rectangular cross section which are inserted on the front side for snap fastening of a structural component part with the spring arranged in the center or at the side. FIGS. 46A and 46B show the creation of a guide channel 4813 for snap elements 4836 at a sheet-metal part, such as a hinge tab 4824, by tack-welding of a rectangular pipe section.

Figure 47A:
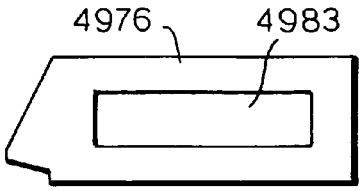
FIGS. 47A and 47B show a broad snap element for absorbing high forces with springs that are biased at both sides in the enclosed nest, buckling of the springs prevents element from falling out.
Figure 47B:
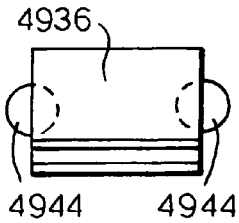
Figure 47C:
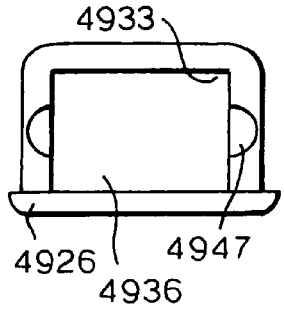
FIG. 47C shows a depression by one half of the spring cross section on both sides for receiving the snap element according to FIG. 47B.

FIGS. 47A and 47B show a broad snap element 9436 for absorbing high forces with springs 4944 that are biased at both sides in the closed nest 4983; buckling of the springs 4944 prevents the snap element 4936 from falling out of the channel 4933. FIG. 47C shows a depression 4947 by one half of the spring cross section on both sides for receiving the snap element 4936 according to FIG. 47B.

Figure 48A:
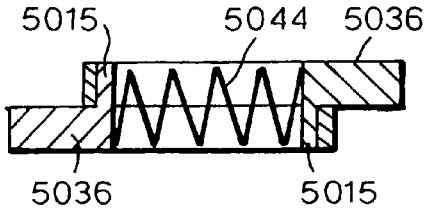
FIGS. 48A and 48B shows a snap element similar to that shown in FIG. 42D with alternately penetrating projections enabling full contact of the spring end faces.
Figure 48B:
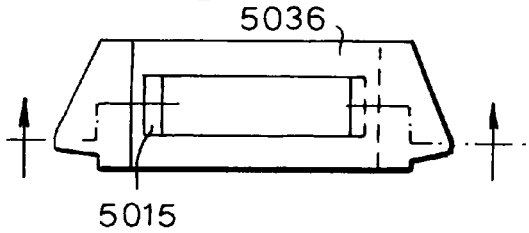

FIGS. 48A and 48B shows a snap element 5036 similar to that shown in FIG. 42D with alternately penetrating projections 5015 enabling full contact of the spring end faces 5044.

Figure 49A:
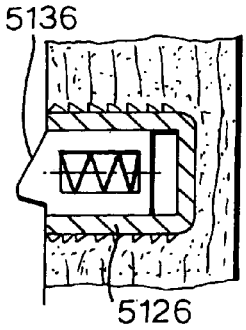
FIGS. 49A and 49B show a snap element inserted in the surrounding housing for mounting in an otherwise unsuitable material such as wood; cross section of the housing is rectangular.
Figure 49B:
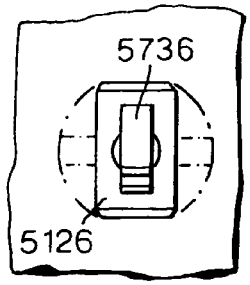
Figure 50A:
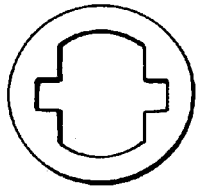
FIGS. 50A to 50C are similar to the above Figs., but with round cross section and with a collar.
Figure 50B:
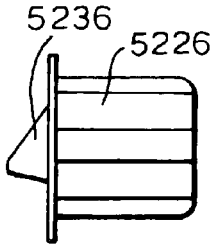
Figure 50C:
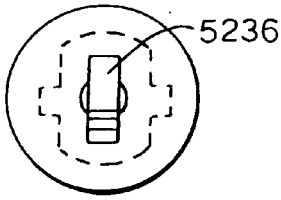

FIGS. 49A and 49B show a snap element 5136 inserted in a surrounding housing 5126 for mounting in an otherwise unsuitable material such as wood. The cross section of the housing 5126 is rectangular in this instance. FIGS. 50A to 50C are similar to the above figures, but the housing 5226 has a round cross section and a collar.

Figure 50D:
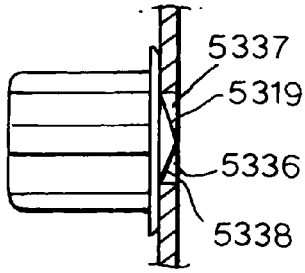
FIG. 50D shows a snap element with identical run-in and run-out angles which can assume the function of a ball catch in cooperation with a bore hole.

FIG. 50D shows an embodiment form with a snap element 5336 with identical run-in and run-out angles which can assume the function of a ball catch in cooperation with a bore hole 5337.

Figure 51A:
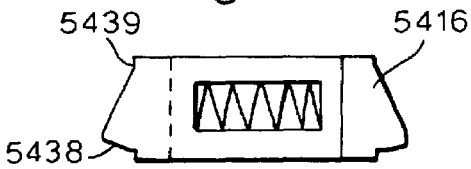
FIGS. 51A to 51C show snap elements similar to those shown in FIG. 42D with an outer centering surface for improved insertion into the installation opening when centering means such as plugs must be omitted for certain reasons.
Figure 51B:
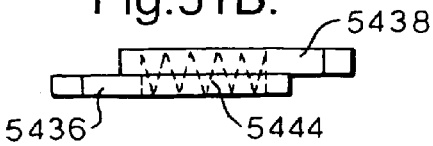
Figure 51C:
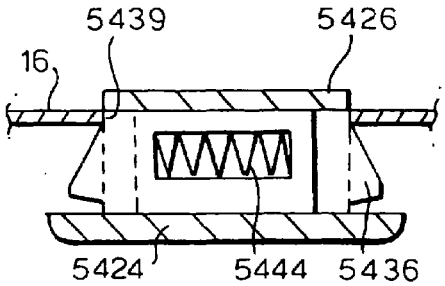

FIGS. 51A to 51C show snap elements 5436 similar to those shown in FIG. 42D with an outer centering surface 5439 for improved insertion into the installation opening when centering means such as plugs must be omitted for certain reasons.

Figure 52A:
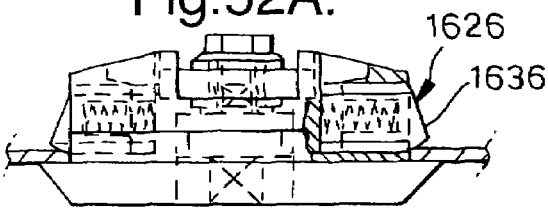
FIGS. 52A and 52B show two different sectional views of a socket wrench lock case with fastening, according to the invention, at the front sides of the lock case, with a cap supporting the follower and having snap arrangements which engage behind the bar.
Figure 52B:
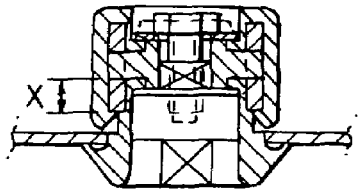
Figure 53A:
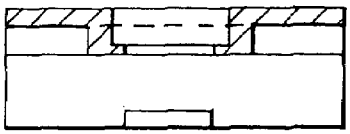
FIGS. 53A to 53C show two different detailed views of the lock case.
Figure 53B:
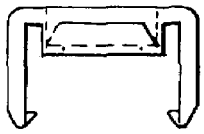
Figure 54A:
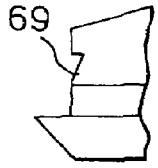
FIGS. 54A and 54B show an embodiment form with a cap which is held at the lock case.
Figure 54B:
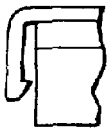
Figure 53C:
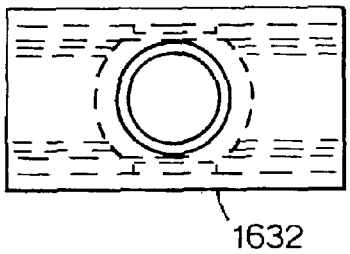
Figure 56:
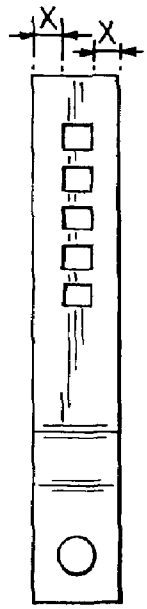
FIG. 56 shows the associated lock bar.
Figure 57A:
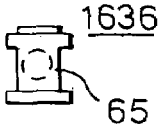
Figure 57B:
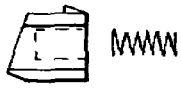
Figure 58A:
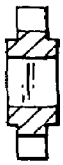
FIGS. 58A and 58B show two different views of the associated pinion.
Figure 58B:
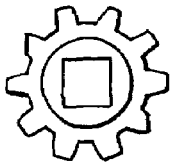
Figure 59:
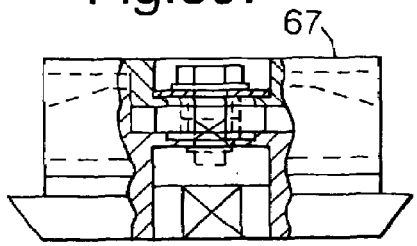
FIG. 59 shows the lock case with the cover arranged thereon.
Figure 55A:
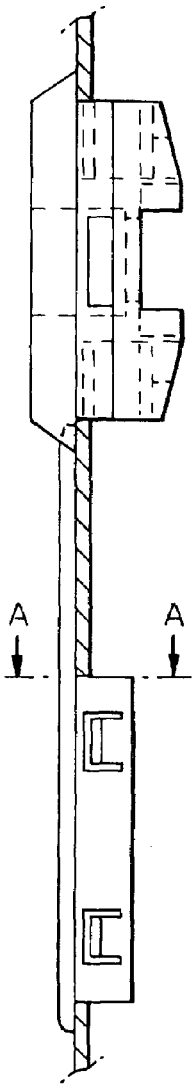
Figure 55B:
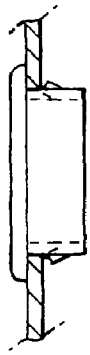
Figure 55C:
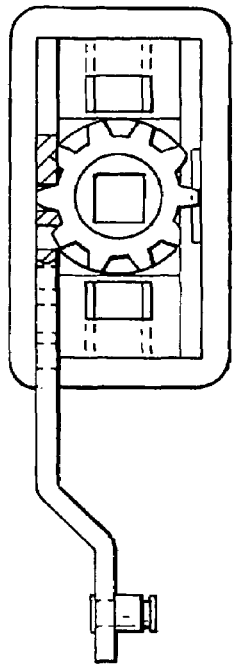
Figure 55D:
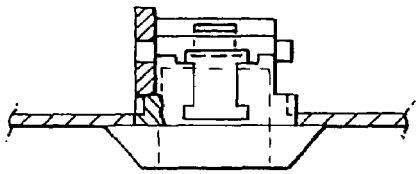
Figure 60A:
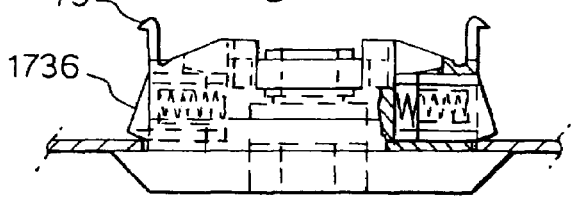
FIGS. 60A to 60C show different views of an embodiment form similar to that shown in FIG. 59, but in which the snap fastening for the cap engages at the front corners in openings.
Figure 60B:
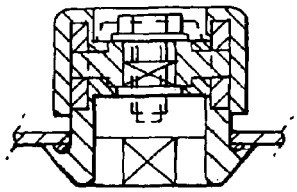
Figure 60C:
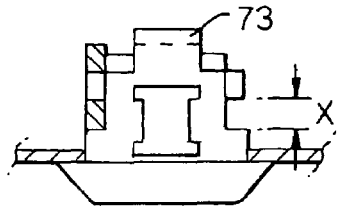
Figure 60D:
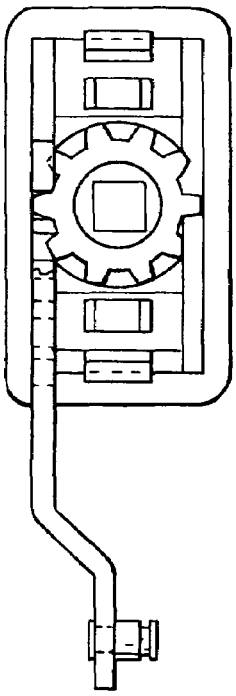

In the embodiment form according to FIGS. 52A, 52B, a fastening is provided by means of fastening elements (see reference number 1636) which are arranged in a channel. The fastening is carried out with holding elements 1636 which are arranged at the front sides and, since they are somewhat shorter than in other embodiment forms, are guided additionally through a groove shown at 65 (see FIGS. 57A, 57B, 57C), while the bearing support of the pinion shown in FIGS. 58A, 58B is carried out in a body part 1632 shown in FIG. 53C. Further, FIG. 59 shows a cover 67 which provides an additional bearing support for the pinion. This cover can be supported either at an offset 69 in the body part of the fitting (see FIGS. 54A, 54B) or at the edges of the latch bars 71 as can be seen in FIGS. 52B, 52B.

Figure 61A:
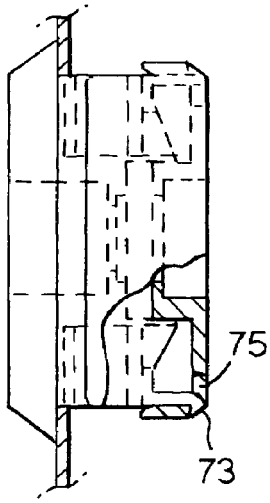
FIGS. 61A to 61D show different views of the lock case according to FIG. 60, but with the cover placed on it.
Figure 61B:
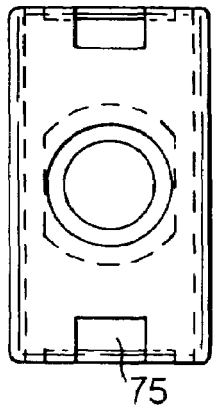
Figure 61C:
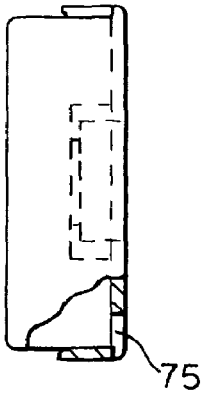

FIGS. 60A, 60B, 60C, 60D show a construction similar to that described above, but in this case the snap fastening for the cap is arranged at the front corners and the latter engage in openings that are formed by the cover which is shown in FIGS. 61A, 61B, 61C and 61D; that is, the hooks 73 engage in the openings 75 shown in FIG. 61C resulting in the mounting shown in FIG. 61A.

Figure 62A:
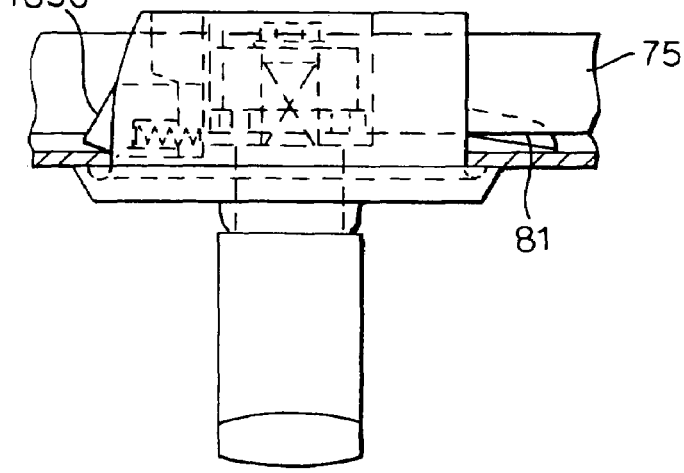
FIGS. 62A to 62B show two different views of a lever actuation with a lock case, wherein fastening is carried out with a hook arrangement on one side and, according to the invention, in a thin wall on the other side.
Figure 62B:
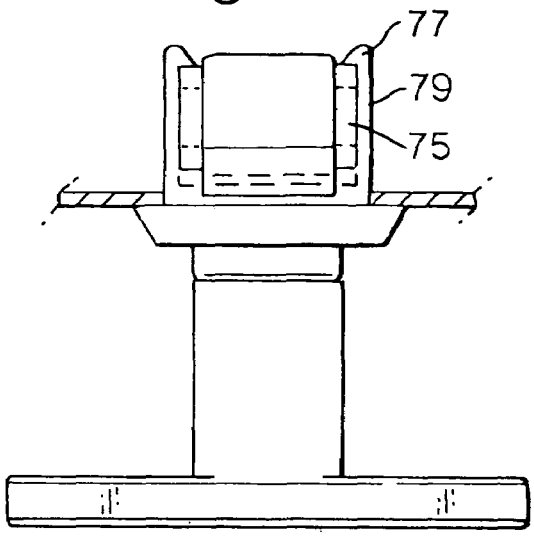

FIGS. 62A, 62B show a toggle latch with a latch bar 75 which operates without a cap and which has a one-part housing instead. Lateral guide webs 79 for the bars carry snap devices 77 and hold the bars in this way. The fastening of the housing is carried out by means of a hook 81 on one side (at right in FIG. 62A) and by means of the holding element arrangement 1836 according to the invention on the other side.

Figure 64A:
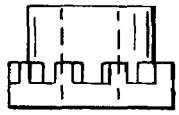
FIGS. 64A, 64B show two different views of the associated wing tongue.
Figure 61D:
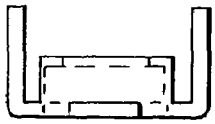
Figure 64B:
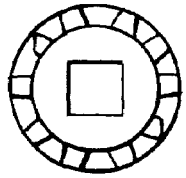
Figure 63A:
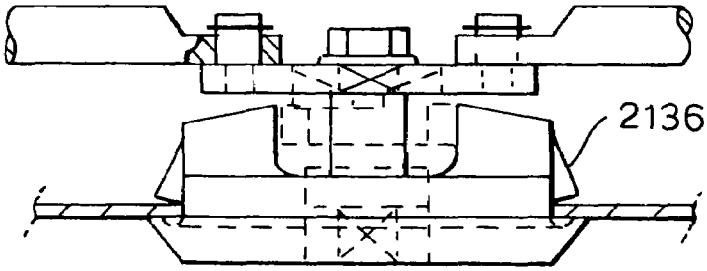
Figure 65A:
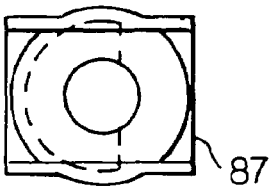
FIGS. 65A to 65C show the associated lock case cover.
Figure 65B:
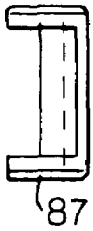
Figure 65C:
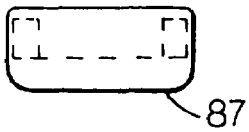

The embodiment form shown in FIGS. 63A, 63B shows a housing with fastening elements 2136 which is snapped in according to the invention. Mounted on the housing is an adapter 87, shown in FIGS. 65A, 65B, 65C, by means of which a wing tongue 89 shown in FIGS. 64A, 64B can be mounted. Round bars 275 are articulated at the wing tongue as is shown in FIGS. 63A, 63B. The adapter forms stop surfaces 91, see FIG. 63C, against which the protuberance 93 stops in order to limit the rotational path of the wing tongue 89.

FIGS. 66A, 66B, 66C show an embodiment form in which a holding device 2236 according to the invention is welded to a sheet-metal hinge 95. The welding is carried out by spot welding, see reference number 97. In the area of the weld fastening, the spring 2336 has a flange 99 having a reinforcing effect (FIG. 72D).

FIGS. 67A, 67B, 67C, 67D and 67E show another embodiment form of the invention in which two holding elements 2636 which are movable relative to one another are supported in a channel so as to be displaceable relative to one another against spring force. The movement of the elements 2636 is limited linearly by a notch 111 in which a headless screw 113 engages. The embodiment forms according to FIGS. 67A to 67C show an arrangement which is economical but also easy to mount. The flat sheet-metal parts to be used can be stamped cheaply. When installed, but not yet mounted on the cabinet sheet metal, the two openings of the sheet metal parts are congruent even when the pressure spring is biased. The three parts, namely, the two snap plates and one pressure spring, which are biased, form a stable assembly in itself so that it can be inserted into the guide channel in a simple manner. The pin which is then pressed in only prevents the unit from falling out. The snap plates do not develop a relative movement caused by the springs until mounted in the installation opening. The entire arrangement is very narrow and therefore saves space. In special situations, the snap plates can also be solitary and can be bent to accommodate to cramped conditions.

FIG. 69A shows the pressure spring. FIG. 69B shows the headless screw. A pin shown in 78C can also be used instead of the headless screw, but could not be disassembled.

FIG. 67E shows how the parts can contact one another in the guide channel. An eversion 115 on one side for the opening can allow the spring to rest at the end over its full surface.

FIGS. 70A, 70B and 70C show a similar embodiment form in which the fastening 2736 according to the invention is used in a swivel lever. The swivel lever drives a sash which secures the door in a frame when the door is closed.

Figure 71B:
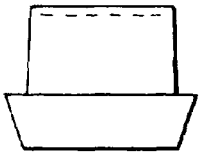
Figure 72A:
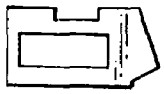
FIGS. 72A and 72B show two different detailed views of the slider.
Figure 72B:
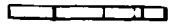

FIGS. 71A, 71B show details of the trough area to be placed in the door leaf, while FIGS. 72A, 72B show two views of the slider.

Figure 73A:
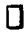
FIGS. 73A and 73B are details showing a headless screw and a spring belonging to the latch according to FIGS. 79A to 79C.
Figure 73B:
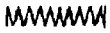

FIG. 73A again shows a headless screw, and FIG. 73B shows a wire spring.

Figure 74A:
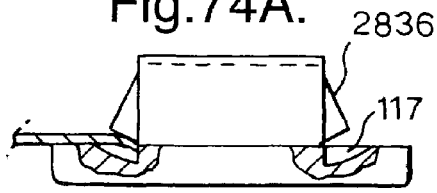
FIGS. 74A and 74B show two different views of a snap hinge in which sheet-metal bulges according to FIG. 84 are not detrimental.
Figure 74B:
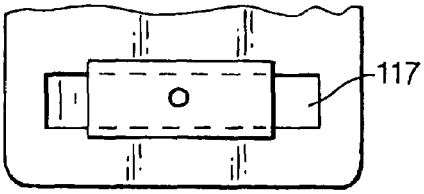

FIGS. 74A, 74B show an embodiment form which solves the problem that occurs when the loading of the snap elements at the sheet-metal edge is excessive and causes an outward bulge. In this case, in the embodiment forms described above, the hinge leaf no longer contacts neatly. In order to solve this problem, an offset in which the bulge 119 is received is created in the area of the snap element on the inner side of the hinge leaf (see reference number 117). The snap element 2836 pushes forward, and secure fastening is still ensured without disadvantages.

Figure 75:
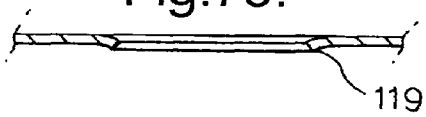
FIG. 75 shows the sheet-metal bulges at the rim of the opening.

FIG. 75 shows a sectional view, at 119, of the bulging sheet metal which can result from high loading at the high edges.

FIG. 74A is a side view of the channel construction with snap elements and offset. FIG. 74B shows a rear view of the channel construction without the snap pieces but with the offset for receiving the bulge.

Figure 76A:
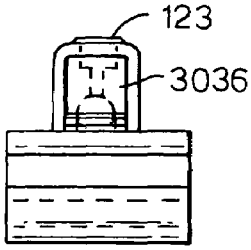
FIGS. 76A, 76B and 76C show three different views of another embodiment form of the invention.
Figure 76B:
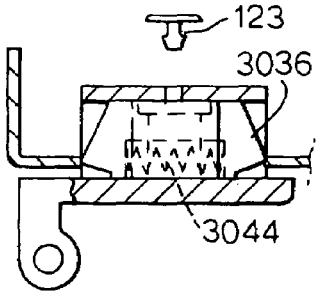
Figure 76C:
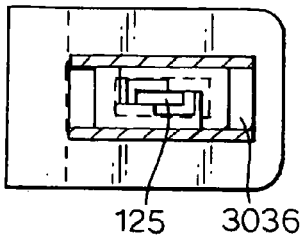
Figure 76D:
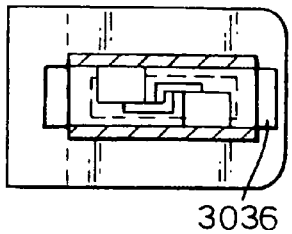
FIG. 76D shows a view similar to that in FIG. 76C, but with the holding elements moved out.
Figure 76E:
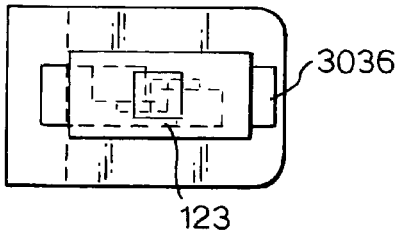
FIG. 76E is a view similar to that in FIG. 76D.
Figure 77A:
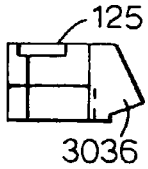
FIGS. 77A to 77C show three different detailed views of the holding element used in FIGS. 76A to 76E.
Figure 77B:
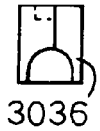
Figure 77C:
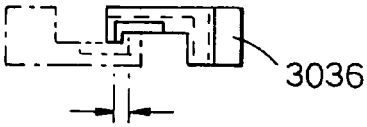

In the embodiment form shown in FIGS. 76A to 76C, the fixing plug 123 which engages in a slot 125 formed by the holding elements 3036 is not loaded by spring 3044 because the oppositely located holding elements 3036 hold one another mutually. The fixing plug 123 holds the holding elements 3036 only in the correct (center) position so as not to interfere with the snap-in process.

The construction enables simplified mounting, and only one spring 3044 is used because the center intermediate wall in the channel which was provided in the other embodiment forms is dispensed with in this case.

FIGS. 76A and 76C show the associated holding elements 3036 as individual parts.

Figure 78A:
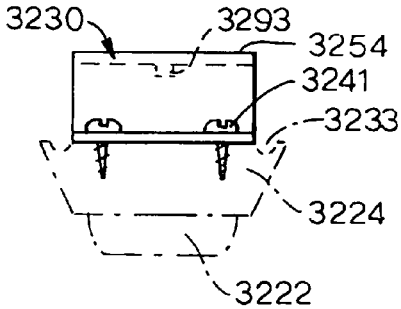
Figure 78B:
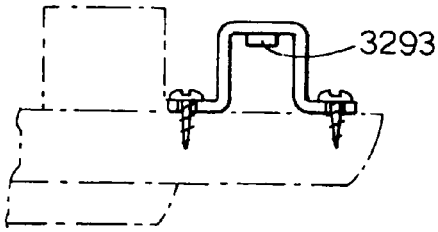
Figure 78C:
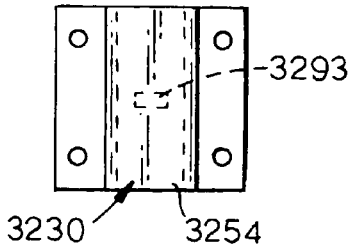

FIGS. 78A to 78C show three different views of a top 3230 which forms the guide channel and which can be screwed on. As regards tools or dies, this is advantageous for arranging channels 3233 for a seal 3233. It is not necessary to work with slides in the die. When the guide channel part is screwed on, the center fixing projection 3299 can be produced by pressing out (sheet-metal part) or casting (pressure die casting, plastic injection molding). The fixing plug 123 which was described in the preceding embodiment form (FIGS. 76A to 76E) would not be needed in this case.

Figure 79A:
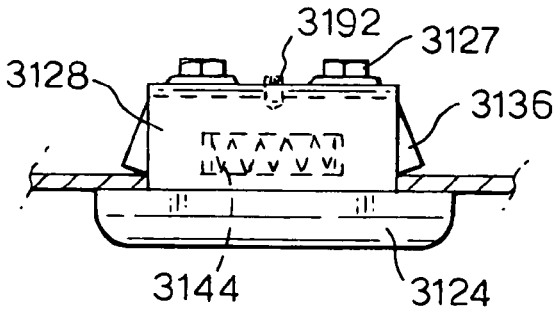
FIGS. 79A to 79C show three different views of an embodiment form for heavy loading in which four snap plates form the holding elements.
Figure 79B:
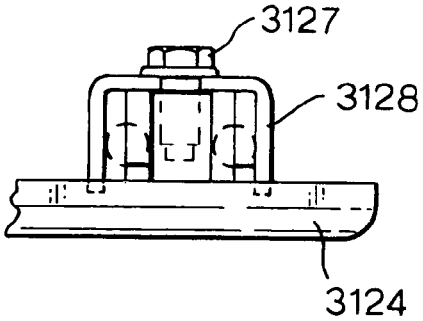
Figure 79C:
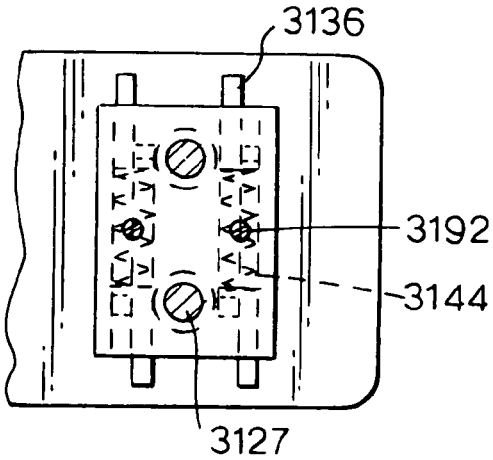

FIGS. 79A to 79C show three different views of an embodiment form in which a particularly heavy load capacity is achieved by an arrangement of four snap plates 3136. The U-part for forming the guide channel 3128 is screwed on in this instance. Supporting U-legs are recessed into the back side of the head part 3124. The snap plates move between the screw cylinders 3127 and in the inner wall of the U-part.

In the embodiment form according to FIGS. 80A, 80B, 80C, 80D, the holding elements 536 are formed by two metal pieces or plastic pieces which lie next to one another. They form projections and recesses that are directed toward one another such that the two holding elements 5536-1, 5536-2 can be drawn back against the force of the spring 5542 by a rotatable tool or key 82 by rotating the tool 82, and the hinge can accordingly be removed from the door leaf 5514. The construction is advisably carried out in such a way that the lever 82 stays in the opened position automatically so that when there is a plurality of hinges they can all be brought into the open position simultaneously and all hinges can accordingly be removed from the door leaf simultaneously.

Figure 80A:
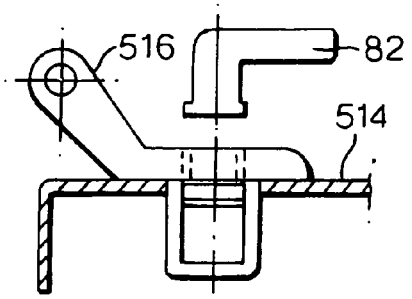
FIGS. 80A, 80B, 80C, 80D show different views of a hinge according to the invention which is detachable by means of a key.
Figure 80B:
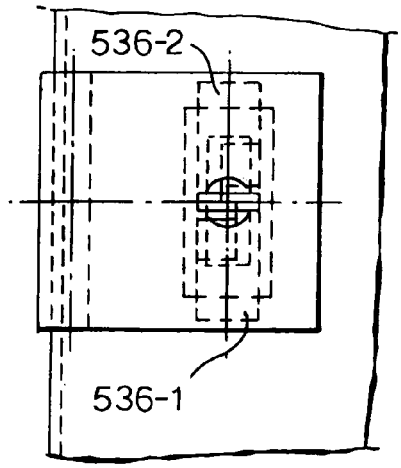
Figure 80C:
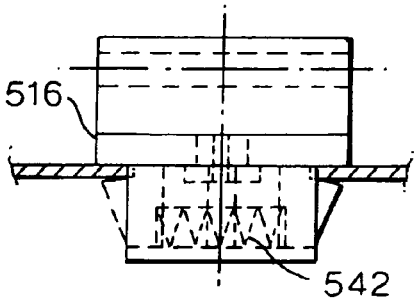
Figure 80D:
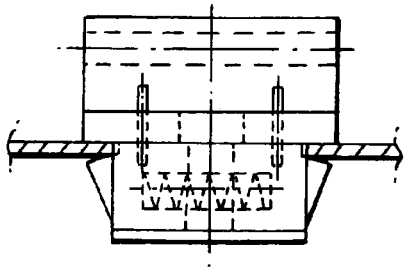
Figure 80E:
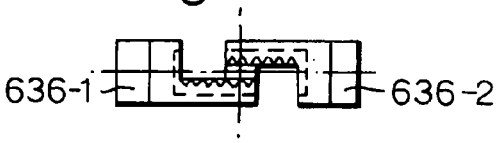
FIGS. 80E and 80F show a modified embodiment form of a hinge that is detachable by means of a key.
Figure 80F:
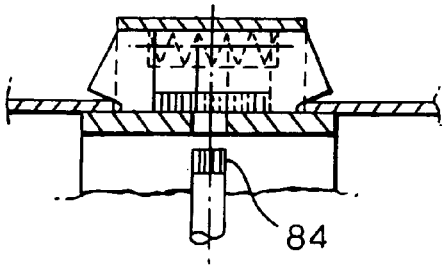

In the embodiment form according to FIGS. 80E and 80F, the tool is provided with a pinion 84 which can engage in corresponding teeth 86 of the two holding elements 5636-1, 5636-2 and makes it possible for the two holding elements to be drawn back into the housing by rotation of the tool along with the pinion 84 in order to pull the housing out of the opening in the thin wall.

Opening is possible from the hinge side, that is, from the outer side of the door leaf area; a blind mounting can also be disassembled again.

Figure 81A:
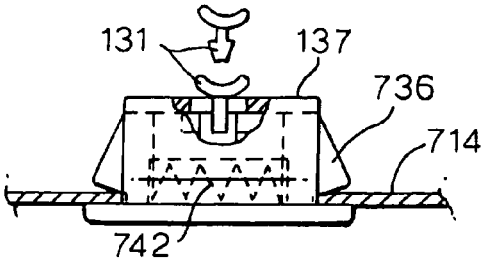
FIGS. 81A, 81B and 81C show different views of another hinge that is detachable by means of a key.
Figure 81B:
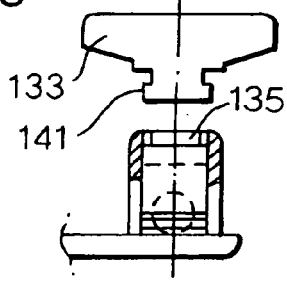
Figure 81C:
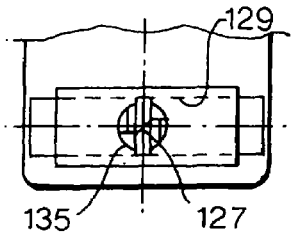

On the other hand, the embodiment form according to FIG. 81A, 81B, 81C provides for removal by means of a tool proceeding from the inner side.

Figure 81D:
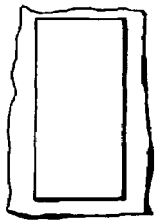
FIG. 81D shows the associated opening in a thin wall.
Figure 81E:
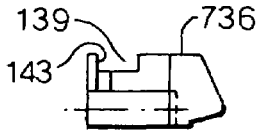
FIGS. 81E and 81F show an associated holding element in two different views.
Figure 81F:
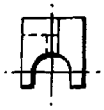
Figure 81G:
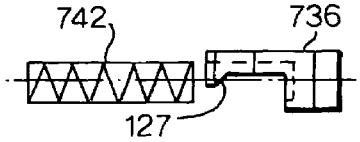
FIGS. 81G, 81H and 81I show additional views of this holding element during operation.
Figure 81H:
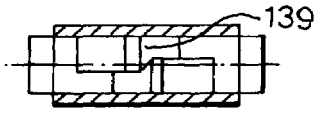
Figure 81I:
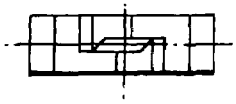
Figure 81J:
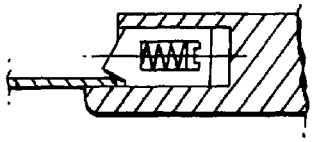
FIGS. 81J, 81K, 81L show another embodiment form of a suitable holding element.

Due to the inclined surface 127 of the holding elements 5736 which extends at 45° (see particularly FIG. 81C and FIG. 81G), these holding elements 5736 are forced outward in the direction of the channel walls 129 by the spring pressure of the spring 5742 so that friction occurs in the channel, and the holding elements are possibly already sufficiently fixed by this friction so that the fixing plug 131 shown in FIG. 81A is not needed. When the plug 131 is not required for securing the holding elements 5736, the plug 131 also need not be removed when the key 133 is to be inserted through the opening 135 in the channel cover 137 in the offset area 139 formed by the two holding elements 5736. When the key 133 is turned in the counterclockwise direction referring to FIG. 81A, the wings 141 of the key press against the endface 143 of the offset area 139 and move the holding element 5736 into the channel until reaching the position shown in FIG. 811, at which time the key is turned by 90° and holds by itself. The entire unit shown in FIG. 81A can then be pulled out of the opening (shown in FIG. 81D) in the thin wall 5714, including additional hinge elements which have likewise been brought into the pulled back position with a corresponding key.

In the embodiment form according to FIGS. 81J, 81K, 81L, 81M, 81N, 81O, 81P, the holding element is formed by a flat metal piece having an opening 84 for receiving the spring 42 and two oppositely located projections 86 which receive the spring 5842 so as to secure it, so that that a handling unit is formed by the holding element and spring.

Figure 81K:
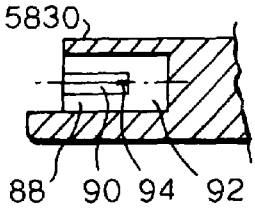
Figure 81L:
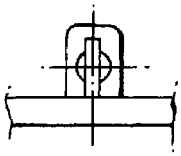
Figure 81M:
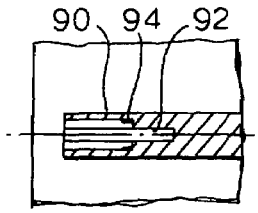
FIGS. 81M, 81N, 81O, 81P show still another embodiment form of the holding element.
Figure 81N:
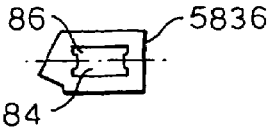
Figure 81O:
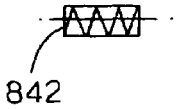
Figure 81P:
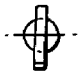
Figure 82A:
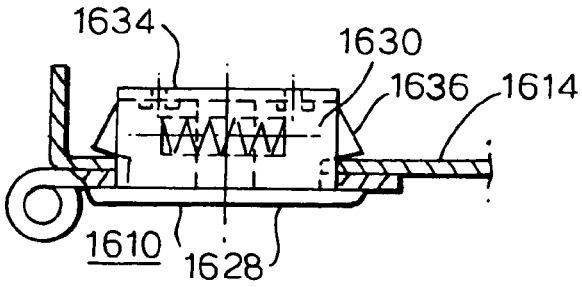
FIGS. 82A, 82B, 82C and 82D show different views of a holding element that is separate from the hinge leaf.
Figure 82B:
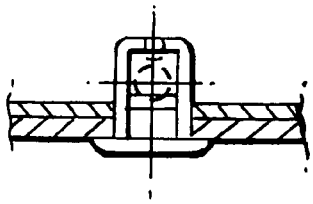
Figure 82C:
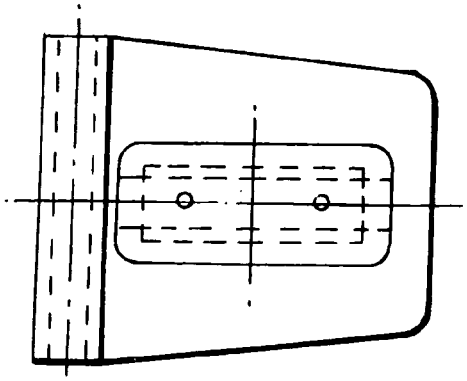
Figure 82D:
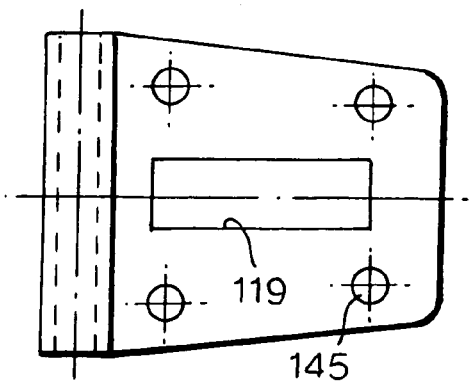

This unit can be received in the correspondingly shaped opening 88 in the body part 38 (see FIG. 81K). The cutout 90 provided for the spring is shorter than the corresponding cutout 92 for the holding element 5836 so that the spring 5842 obtains a contact surface when the holding element 8536 is pushed into the position according to FIG. 81J.

When a knob 94 is arranged at the end of the cutout 90 for the spring, the spring can be secured at the latter and the holding element 5836 is prevented from falling out with the spring 5842.

FIGS. 82A, 82B, 82C and 82D show a hinge in which the hinge part has an opening 119 like the thin wall 1614, wherein the holding part 1634 and the body part 1630 have their own head part 1628. Further, the hinge part shown in FIG. 16D has bore holes 145 for an alternative fastening by means of head screws.

Figure 83A:
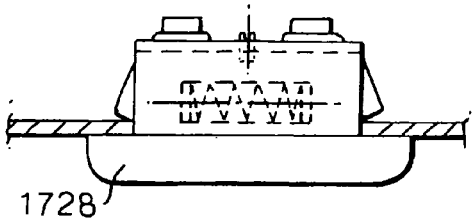
Figure 83B:
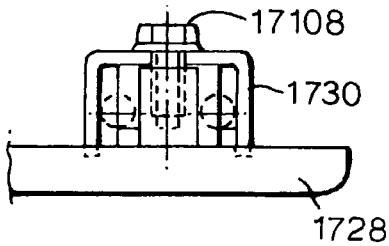
Figure 83C:
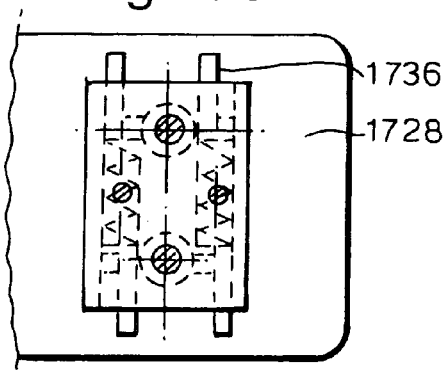

In the embodiment form shown in FIGS. 83A, 83B and 83C, the head part 1738 and body part 130 are two parts which are screwed together, wherein two screws 17108 are used. In order to increase stability, the pairs of holding elements 1736 are doubled and are arranged symmetrically on the right-hand and left-hand side of the screw arrangement 17108.

Figure 84B:
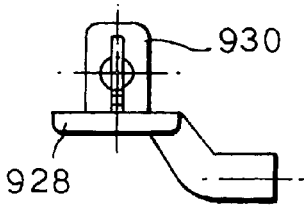
Figure 84D:
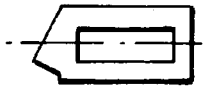
Figure 84E:
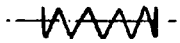
Figure 84F:
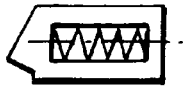
Figure 84A:
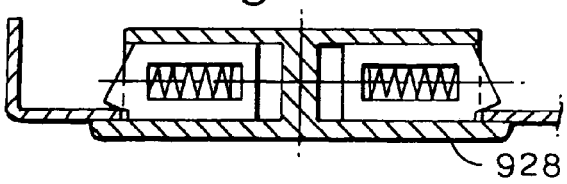
Figure 84G:
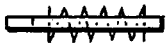
Figure 84C:
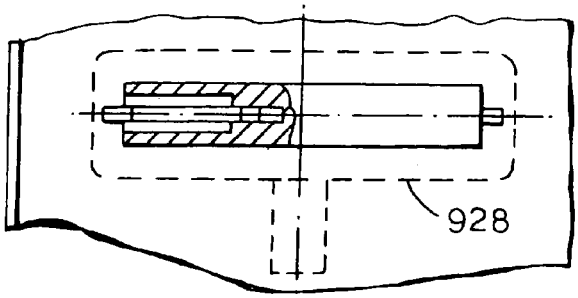
Figure 84H:
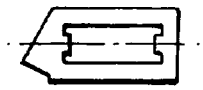
Figure 84I:
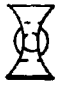

The embodiment form according to FIGS. 84A, 84B, 84C is constructed in a similar manner. The fastening element in FIG. 84D and the spring in FIG. 84E are shown in FIGS. 84F and 84G as parts which are fixedly connected to one another. Holding projections are provided in FIG. 84H. Further, the holding element has a shape deviating from the flat shape for reasons of stability (see FIG. 84I).

Figure 85A:
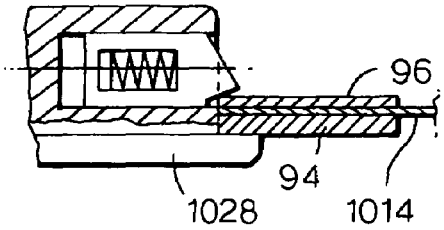
Figure 85B:
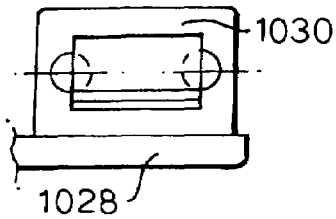
Figure 85C:
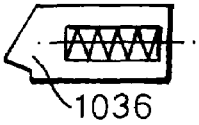

Two springs are provided in the embodiment form in FIGS. 85A, 85B, 85C. These springs are inserted laterally in the associated holding element 36. The other half of the spring element is received by the body part 1030. FIG. 80A shows the special feature that reinforcement plates 94, 96 are provided on both sides in case of very thin wall material. The reinforcement pates 94, 96 are clamped in by the holding elements and therefore also hold and support the thin door leaf 1014.

Figure 85D:
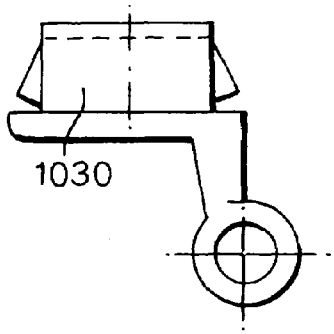
Figure 85E:
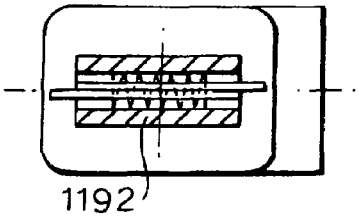
Figure 85F:
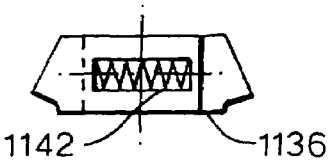
Figure 85G:
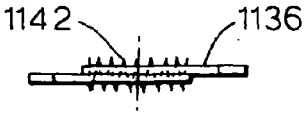

The embodiment form according to FIGS. 85D, E, F, G and H provides two metal pieces 136 which side by side and are held jointly by a spring 1144 in such a way that these three parts form a handling unit which is stable in itself, that is, they can be handled separately and, if required, can be inserted into a corresponding recess in the body part 1130 as can be seen in FIG. 90E.

By means of knobs 1192 arranged in this area, the construction can also be held in position.

Figure 85H:
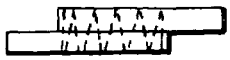
Figure 85I:
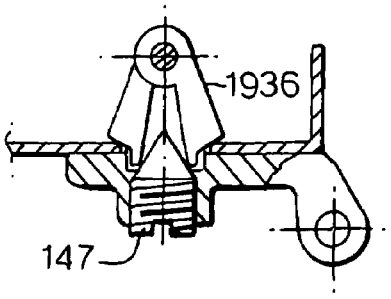

According to FIG. 85H, the two metal parts are thicker so that, together, they can receive the spring.

Figure 87:
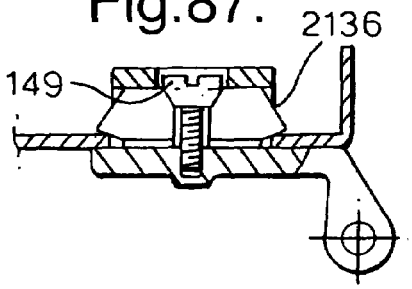
Figure 88:
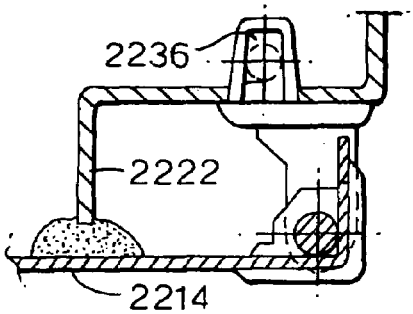

In the embodiment form shown in FIG. 87, the head of the screw 149 is conical and presses the two holding elements 2136 apart.

Figure 86A:
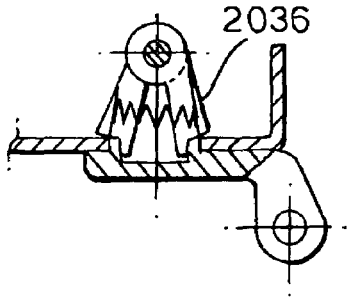

Compared to a construction according to FIG. 86A in which a spring spreads the two holding elements 2036, the embodiment forms with the conical screw have the disadvantage that the screw must be tightened manually when the sheet-metal edges become rounded or bulge out subsequently under load. A spring readjusts automatically and compensates automatically.

Figure 2:
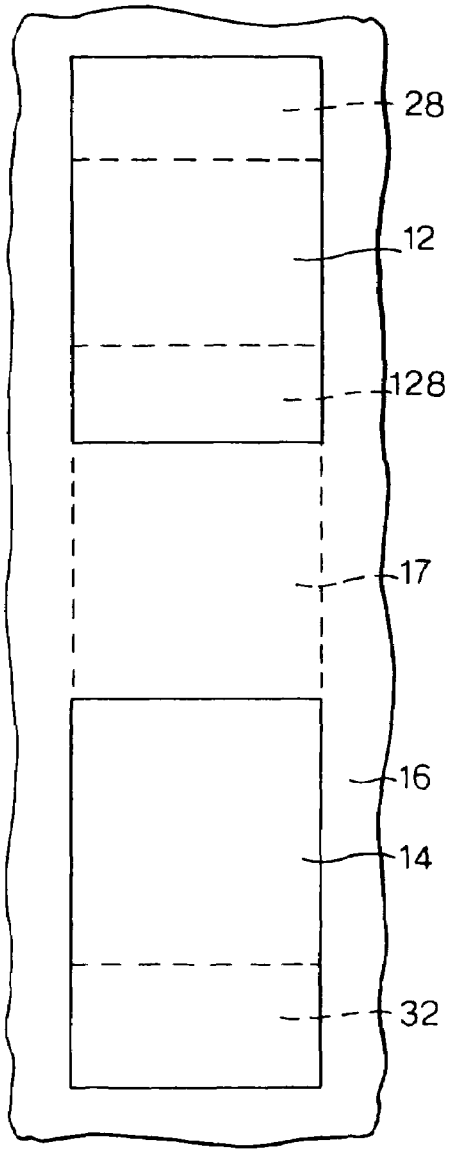
FIG. 2 shows two openings in which a swivel lever latch according to FIGS. 1A, 1B with snap devices can be installed.
Figure 86B:
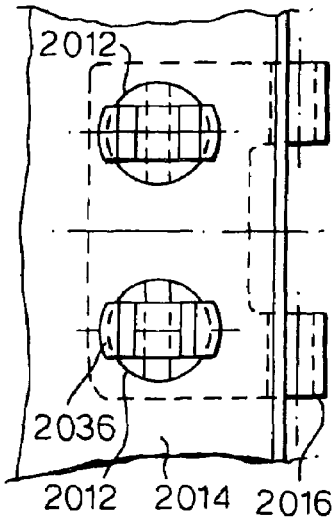
Figure 86C:
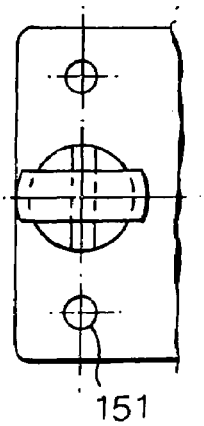

The opening in the thin wall need not necessarily be rectangular as is shown, for example, in FIG. 2. In itself, it can also have any other shape, e.g., oval or round. A round embodiment form can be seen in FIG. 86B. However, in this case means must be provided for preventing rotation, which is provided when the shape of the opening is rectangular but not when the opening is round. The first hinge part (e.g., fastened to the door) can be secured, for example, by the second hinge part in case this second hinge part is arranged securely enough (e.g., at the frame) or by the arrangement of two round openings 2012 which are arranged at a distance from one another, as is shown in FIG. 86B, or also by additional pins 151 which are cast integral with the hinge part and which prevent rotation (see FIG. 86C) insofar as there are corresponding bore holes in the door leaf which accept these pins.

FIG. 89 is a cross-sectional view through a window frame 2514 with an elongated opening 2512 in which a hinge part 2516 made from a pressed aluminum profile can be inserted and then secured subsequently by means of a T-shaped wedge element 2536. Manufacture is more economical because the pressing tool and the production are simpler. Also, the eyelet for a pin 2520 can be left open and can accordingly be produced during the pressing process.

FIGS. 90A, 90B and 90C show three different views of a short plate individually. FIGS. 91A and 91B show two views of a suitable holding element having the shape of a double-T in cross section. FIGS. 92A and 92B show two views of one half of the associated two-part lock case.

FIGS. 90A, 90B and 90C show different views of a head part or escutcheon with a run-in surface 44 and, further, with a hook contour and fixing contour 92 for a pre-assembled bar lock that is constructed, for example, from the halves according to FIGS. 92A and 92B. These halves have notches 90 for hooking with the escutcheon or swivel-out lever handle member.

The embodiment form shown in FIGS. 93A to 93B is suitable for spindle actuation as is indicated in FIG. 93A and for swivel lever actuation (see FIG. 93H). The specially designed fastening hook 17 holds the trough 716 securely in the sheet-metal cutout in the lower area. The attachable cap 715 shown in FIG. 93H need only press the seal 781 against the door leaf 14, which is shown in cross section in FIG. 93H, and conform to the shaped part of the cap shape. Possible snap surfaces which cooperate with corresponding ribbing of the snap surfaces 785 of the trough are shown in FIG. 93B at 783.

The pinion 750 according to FIG. 93A drives the latch bars 52, 152 and is itself driven by a lever 718 by means of a square spindle. Pre-assembly of the handle 718 in the trough 716 can be carried out by means of a shaft retainer 719.

According to FIG. 93A, a socket wrench actuation 796, e.g., formed as a square or as a handle actuation, shown in dashes, is provided.

The two halves of the lock case 724, one of which is shown in FIGS. 93F and 93E, can be snapped together, namely, by means of spring inserts 723 which are received in corresponding pockets by snaps. The springs of the projections 723 engage behind engagement edges 731, and the two halves which are snapped together are joined to form a lock case 724. The lock case 724 formed in this way has pockets 733 for slides 736 and a pocket 735 for the associated spring 732. Similar to other embodiment forms already described above, support elements 734 proceed from the head part or the trough 716 with run-in bevels 744 which push the slides outward when the lock case 724 is placed on the support elements 734 of the trough 716. The spring 732 is accordingly stretched and subsequently, when the lock case 724 is positioned on the support element 734, penetrates into the opening with the offset surface 740 and locks therein.

A finger grip 737 is provided for mounting the slides, the slides 736 can be pulled out by means of the finger grip 737, and the latter attains the release position.

The head part 716 can have a centering projection 739 in order to center the head part 716 in the wall cutout 12. The embodiment form can be changed from the left-hand side to the right-hand side by reversing the lock case 724 (see FIG. 93B).

The lock case 724 according to FIG. 93H has an offset 741 into which a projection 739 projecting over the sheet metal 14 can penetrate so as to center the lock case.

In the embodiment form shown in FIGS. 94A to 94E, the lock case 824 can be separated again from the escutcheon or body part 816 that is clipped to it by actuating buttons. The push buttons 837 according to FIGS. 94A to 94D are simply inserted prior to mounting the lock case 824. Their inward movement is limited but can be pressed back into the release position when actuating the snap elements 836 which carry out a swiveling movement rather than a linear movement in this instance.

The four rivets 821 shown in FIG. 94E could also be replaced by rectangular snaps for holding together the halves of the lock case when the latter is made from a suitable flexible material such as polyamide PA.

The holding elements 836 with spring 832 is arranged so as to be swivelable around an axis 11 which is arranged at a distance from the wall surface plane and which extends parallel to this plane. The holding element 836 has at its end an upward cam 13 with which the holding element 836 lies behind a back-engagement surface 45 in the end position as can be seen in FIG. 94C. In this position, structural component part 824 can no longer move away from structural component part 816. At the same time, the door panel 14 is clamped between them, and the fitting is held securely in the door leaf so as to be centered again at the same time as was already described.

The support elements 836 only achieve the release position when the push buttons 837 on both sides are actuated, so that the bar latch 810 can be disassembled.

FIG. 94D shows the bent door leaf 14 as well as a door frame 114 which together form a bend area in which the compact lock 824 can be accommodated. The escutcheon 816 can be provided for socket wrenches, L-shaped or D-shaped handles, and lever latches.

Figure 95A:
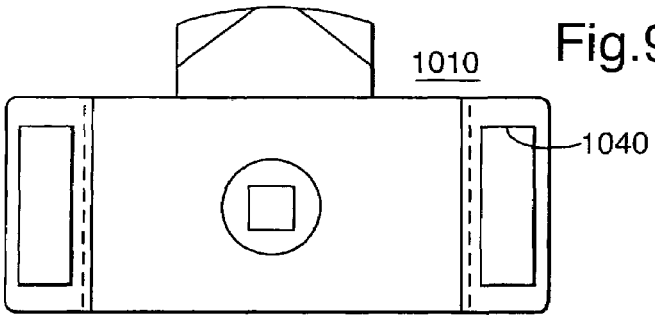
Figure 95B:
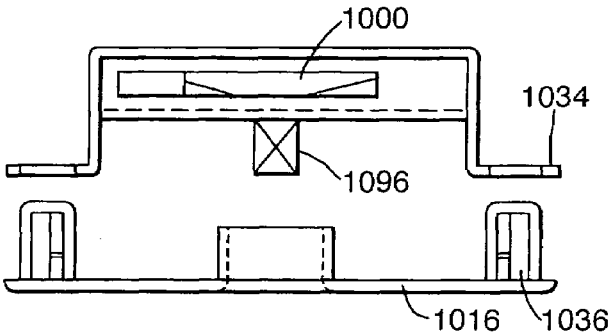
Figure 95C:
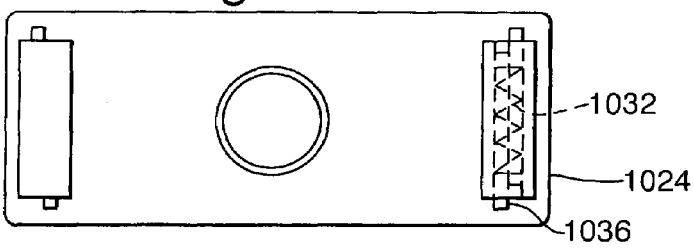
Figure 95D:
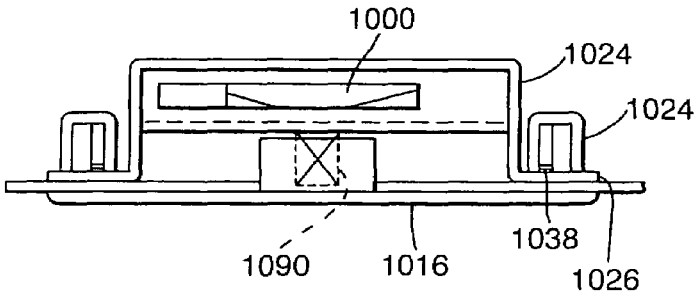
Figure 95E:
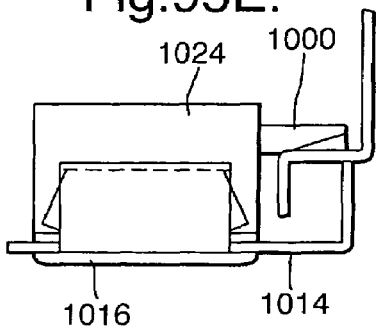
Figure 95F:
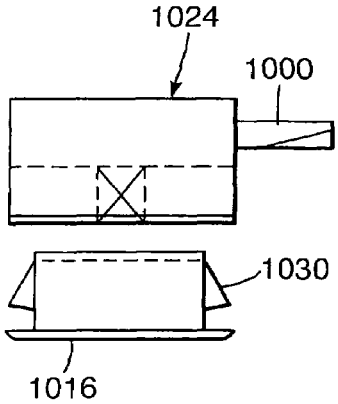

FIGS. 95A to 95F show a particularly simple embodiment form in which the slides 1036 are formed or carried by the head part 1016 in a kinematic reversal (see particularly FIGS. 95B and 95F).

The slides 1036—two opposed metal plates enclosing a spiral spring 1032—engage, respectively, with a projection or support element 1026 which is formed by the lock case 1024. This projection 1026 in turn engages with the inner opening rim 1028 of the thin wall 1016. To this extent, an "indirect snap fastening" is also provided in this instance.

In the present embodiment form, a turn lock 1000 is provided instead of the bars, but this turn lock 1000 (or a (double-)lever connected to the drive—square spindle 1096—) can also have bars articulated thereon.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10 swivel lever latch
12 rectangular opening
13, 3913 channel
14 rectangular opening
15, 5039 projection
16, 216, 416 thin wall, door leaf, sheet-metal door
17 center web
18 outer side
18 run-in bevel
20 rim
22 swivel lever, hand lever
24, 124, 2424, 3124, 3224, 3624, 3724, 3824, 3924, 4024 trough, escutcheon, head part
26, 326, 3226, 3626, 3726, 3826, 3926, 4026 body part
27, 3127 head screws, screw cylinder
28, 228, 3128, 3228 body part, snap fastening, guide channel
29, 3929 elongated hole
30, 3230 body part, receiving area, top
31 grooves
32, 232, 1632 body part, snap fastening
33, 3233 sealing rings, sealing strips
34 outer surface of the body part
35 groove

36, 136, 236, 336, 436, 536, 636, 836, 1036, 1136, 1636, 1836, 2136, 2236, 2636, 2736, 2836, 3036, 3136, 3236, 3336, 3436, 3636, 3736, 3836, 3936, 4036 holding element or tongue element, lever (arrangement)
37, 5337 threaded bore hole, bore hole
38 inclined surface, stop bevel,
39, 5439 pocket hole, centering surface
40 edge
42 inner side of the thin wall
443 hole
44, 144, 244, 344, 3044, 3244, 3644, 3744, 3844, 3944, 4044 spring
45 pin
46 locking element
47, 3947 pocket hole, nest
48 locking element
49 bore hole
50, 150, 250, 450 (door) frame
51 hook
52 sash (tongue)
53 inner toothing
54 cylinder
56 slide
58, 358 (intermediate) wall
4059 hook
60, 3860 axis
61, 3661 axis
62 axis
4363 hook
64 rotatable cross-stop
65 guide groove
66 drive shaft
67 cover
68 axis
69 offset
70, 170 tongue, cam
71 bars
72 screw
73 hook
74 offset surface
75, 275 bar, round bar
76 key
77 snap devices
78 opening
79 guide web
80 bottom, first hinge part
181 hook
82, 282, 382 second, top hinge part
4183 insert
84 hinge pin
4185 opening for spring
86 bore hole
87 adapter
88, 388 tab
89 wing tongue
90 offset
91 stop surfaces
92 pin
93, 3293 protuberance, fixing projection
94, 4094, 4194 wedge, pin, indentation
95 sheet-metal hinge
96 wall opening
97 spot welding
98 conical screw
99 flange
100 hook
101 blade
4402 bore hole widening diagonal guide
4105 projection
4106, 4306 assembly
4307 opening
4308 half-shell
111 notch
113 headless screw
115 one-sided eversion
117 offset
119 bulge
123 fixing plug
125 slot

The invention claimed is:

1. A snap fastening for fast mounting of fittings such as socket wrench latches, swivel lever latches, hinge parts in openings in a thin wall, comprising:

a head part which is to be arranged on one, outer side of the thin wall and which overlaps an outer rim of the opening;

a body part which proceeds from the head part and projects through the opening in the mounted position;

holding elements which project from the body part and are flexible in direction of an outer surface of said body part, a free end of each of said holding elements being provided with a first inclined surface such that the holding element is pushed back against a spring force of a spring by the opening edge and with a second inclined surface for supporting the body part without play on the rim or edge of the opening of the other, inner side of the thin wall;

said second inclined surface being substantially perpendicular to the first inclined surface;

said body part, holding element and said spring being separate parts;

said holding elements being slides which are arranged so as to be displaceable in a cylinder, formed in the body part, that is parallel to the plane of the thin wall and is rectangular in cross section; and said slides being held against the spring force by a hook arrangement locking between the slides or in the cylinder, or by friction forces, or by a pin.

2. The snap fastening of claim 1;

wherein said first inclined surface is a run-in bevel and said second inclined surface is a stop bevel.

3. The snap fastening according to claim 1, wherein supporting elements are provided for supporting the holding elements after the fitting is mounted in the thin wall, said supporting elements being held or carried by the body part.

4. The snap fastening according to claim 3;

wherein the supporting elements that support two holding elements which are arranged diametrically opposite from one another are spring arrangements, such as spiral springs and/or wedge arrangements, such as a tapered-head screw.

5. The snap fastening according to claim 1;

wherein each holding element has a part which is flat in a movement direction in which the holding elements are displaceable, and a strip proceeds from one or both lateral edges of the part for improved guidance in the movement direction.

6. The snap fastening according to claim 1;

wherein each holding element has a projection or recess which cooperates with a recess or projection, which determines the travel in the movement direction and which is carried or formed by the body part or cylinder.

7. The snap fastening according to claim 6;
wherein each holding element is a part which is flat in the movement direction and which has an opening, and projections for orienting the spiral spring proceed from the side edges of the flat part which extend transverse to the movement direction.

8. The snap fastening according to claim 1;
wherein each holding element has a substantially rectangular opening which extends in the movement direction and in which a spiral pressure spring is inserted.

9. The snap fastening according to claim 8;
wherein each holding element is a part which is flat in the movement direction and which has a width that is less than the round diameter of the spring.

10. The snap fastening according to claim 9;
wherein each holding element holds a buckling spring.

11. The snap fastening according to claim 8;
wherein a channel receiving each holding element enters into a clamping engagement with a portion of the spring projecting out of the holding element.

12. The snap fastening according to claim 8,
wherein each holding element has two lateral nests located across from one another for receiving one half of the width of the spring, and a channel has a suitably dimensioned offset for the rest of the spring width.

13. The snap fastening according to claim 8;
wherein when two holding elements are arranged side by side these holding elements have projections at the transverse edges of the respective opening for receiving the spring, which projections project into the other respective opening and form supporting surfaces for the spring.

14. The snap fastening according to claim 8;
wherein each holding element comprises an, assembly of a first, a second, and possibly additional flat parts, each with a rectangular opening, which have a common opening for receiving a spiral pressure spring in a flush manner in such a way that the spiral spring is pressed into the work position in the unloaded state.

15. The snap fastening according to claim 1;
wherein each holding element is accommodated in a housing which, in turn, can be mounted in a thick wall.

16. The snap fastening according to claim 1;
wherein each holding element has inclined surfaces having identical run-in and run-out angles and accordingly works as a ball catch.

17. The snap fastening according to claim 1;
wherein each holding element in front of the run-in bevel forms a straight-line centering surface.

18. The snap fastening according to claim 1;
wherein each holding element forms projection surfaces, offset surfaces or threaded surfaces in which a tool such as a wrench or screwdriver blade can engage for displacing the holding element or holding elements into the pushed back position.

19. The snap fastening according to claim 1;
wherein when the two diametrically oppositely arranged holding elements are loaded to different extents, such as when a sash is used, the holding element upon which the smaller load is exerted is made of flexible plastic such as polyamide and the other holding element, upon which the greater load is exerted, is made of rigid material such as metal.

20. The snap fastening according to claim 1;
wherein the holding elements are slides comprising a rigid material such as metal which are arranged so as to be displaceable in a cylinder which is parallel to the plane of the thin wall and is rectangular in cross section and are held against pressure spring force by a pin arrangement that is arranged between the slides.

21. The snap fastening according to claim 20;
wherein the pin arrangement comprises screws that can be screwed into the head part.

22. The snap fastening according to claim 21;
wherein the screws determine the extent of the movement of the holding elements.

23. The snap fastening according to claim 1;
wherein the body part has a partial dividing wall or undercut or opening edge at which the slides are supported axially by a shoulder or hook.

24. The snap fastening according to claim 1;
wherein the holding elements are formed by displaceably supported slides whose movement axis extends perpendicular to the longitudinal extension of the fitting.

25. The snap fastening according claim 1;
wherein the holding elements are formed by displaceably supported slides whose movement axis extends parallel to the longitudinal extension of the fitting.

26. The snap fastening according to claim 1;
wherein each holding element is formed by a stamped part.

27. The snap fastening according to claim 1;
wherein the head part has an offset in the area of each holding element for receiving edge bulges.

28. The snap fastening according to claim 1;
wherein two or more holding elements are arranged side by side.

29. The snap fastening according to claim 1;
wherein the body part and head part are injection molded to form one piece.

30. The snap fastening according to claim 1;
wherein the body part and head part are two parts which are screwed together or welded together or snapped together.

31. The snap fastening according to claim 1;
wherein the fitting is a swivel lever latch or a folding lever latch for fastening in an elongated opening or in two shorter rectangular openings, wherein one opening receives a lever bearing and the other opening receives a lever stop wherein at least one of the openings also serves to receive at least one body part with holding elements.

32. The snap fastening according to claim 31;
wherein the swivel lever latch or folding lever latch has a trough for receiving the actuating lever in a lockable manner, wherein the trough forms the head part of one or two body parts with holding elements in the area of the lever bearing such as a drive shaft.

33. The snap fastening according to claim 31;
wherein the swivel lever latch or folding lever latch has a trough for receiving the actuating lever in a lockable manner, wherein the trough forms the surface behind which the cam of a lever stop engages on the one hand and forms the head part of a body part with holding elements in the area of the lever stop on the other hand.

34. The snap fastening according to claim 1;
wherein the fitting is a hinge part.

35. The snap fastening according to claim 1;
wherein the fitting is a bar guide.

36. The snap fastening according to claim 1;
wherein the fitting is a lock case.

37. The snap fastening according to claim 1;
wherein the fitting is a grip pipe.

38. The snap fastening according to claim 1;
wherein the fitting is a socket wrench bearing.

39. The snap fastening according to claim 1;
wherein the fitting is a sash latch.

40. The snap fastening according to claim 1;
wherein the fitting is a grip projection.

* * * * *